US005865036A

United States Patent [19]

Anthony

[11] Patent Number: 5,865,036

[45] Date of Patent: Feb. 2, 1999

[54] SELF-COOLING BEVERAGE AND FOOD CONTAINER AND MANUFACTURING METHOD

[76] Inventor: Michael Anthony, 11899 NW. 31st St., Coral Springs, Fla. 33065

[21] Appl. No.: 824,468

[22] Filed: Mar. 26, 1997

Related U.S. Application Data

[63] Continuation-in-part of Ser. No. 534,453, Sep. 27, 1995, Pat. No. 5,704,222.

[51] Int. Cl.[6] ..... F25D 3/08

[52] U.S. Cl. ..... 62/293; 62/371

[58] Field of Search ..... 62/293, 294, 371, 62/457.3, 457.4

[56] References Cited

U.S. PATENT DOCUMENTS

| | | | |
|---|---|---|---|
| 3,320,767 | 5/1967 | Whalen | 62/294 |
| 4,669,273 | 6/1987 | Fischer et al. | 62/371 |
| 5,361,604 | 11/1994 | Pier et al. | 62/371 |

*Primary Examiner*—William E. Tapolcai
*Attorney, Agent, or Firm*—Oltman, Flynn & Kubler

[57] ABSTRACT

A rapid refrigeration apparatus includes a container having a container upper end, a container wall with a container opening in the container upper end bordered by a container rim, the container liquid container contents; a receptacle extending within the container and containing a refrigerant, the receptacle including a cup portion sized to fit into the container opening, a cup flange sized to rest against and sealing secured to, the container rim and a cup wall, at least a portion of which is expandable, the cup wall having cup wall opening mechanism for releasing the container contents into the receptacle; and a lid sealingly secured to the cup flange and including a lid opening mechanism for releasing the refrigerant from the receptacle into the atmosphere and for releasing the container contents from the receptacle for consumption; the lid opening mechanism including a lid opening mechanism activation mechanism for voluntarily opening the lid opening mechanism at a selected moment in time.

13 Claims, 26 Drawing Sheets

SELF-COOLING BEVERAGE AND FOOD CONTAINER AND MANUFACTURING METHOD

FILING HISTORY

This application is a continuation-in-part of application Ser. No. 08/534,453, filed on Sep. 27, 1995, now U.S. Pat. No. 5,704,222.

BACKGROUND OF THE INVENTION

1. Field of the Invention

The present invention relates generally to the field of food and beverage containers. More specifically the present invention relates to a self-cooling container apparatus containing a beverage or other food item and to methods of assembling and operating the apparatus. The terms "beverage", "food item" and "container contents" are considered equivalent for purposes of this application and used interchangeably.

For the first several preferred embodiments, the apparatus includes a container such as a can containing a beverage and having a conventional unified bottom and side container wall terminating in an upper sealing flange referred to hereinafter as a container rim. A refrigerant receptacle is provided including a receptacle cup having a cup wall having an expandable portion and having a cup sealing flange, hereinafter referred to as a cup rim, which extends laterally from the cup wall. As an alternative to the cup with an expandable wall, a secondary vessel is placed within the container to contain the beverage and to define a narrow annular refrigerant chamber between the container and vessel, providing an broad surface area for heat transfer. A conventional beverage can lid is further provided, including a lid panel with a lid opener mechanism and a lid lateral edge.

A method of apparatus assembly is provided including the steps of lowering the cup through the container rim so that the cup displaces some of the beverage in the container; resting the cup rim on top of the container rim; placing the lid on top of the cup so that the lid lateral edge rests on the cup rim; and crimping the lid lateral edge and cup rim onto the container rim. Either before or after the lid is placed onto the cup, a refrigerant chilled to a liquid state is introduced into the cup. After crimping, the refrigerant is warmed to ambient temperature, whereupon it partially evaporates and develops internal pressure against the cup wall and the lid.

A method of operation is provided in which the consumer operates the lid opener mechanism to open the lid and thereby releases vaporized refrigerant from the receptacle cup. The remaining liquid refrigerant progressively boils into a vapor state and escapes through the opener mechanism, drawing heat out of the beverage through the cup wall. Once all of the refrigerant has been released, the cup wall is opened with a cup wall opener mechanism to permit the beverage to flow into the cup, and then out of the container through the lid opener mechanism for consumption.

2. Description of the Prior Art

There have previously been self-cooling containers for food items including refrigerant receptacles with widely spaced apart, rigid receptacle walls. The receptacle is opened when cooling is desired and the refrigerant is progressively discharged from the receptacle, extracting heat from the container contents. A problem with this construction is that, as the volume of the liquified refrigerant falls during discharge, the refrigerant surface area in thermal contact with the walls of the receptacle diminishes, so that progressively colder refrigerant is in contact with a progressively smaller conductive surface area. The result is an exponentially falling refrigerant evaporation rate.

It is thus an object of the present invention to provide a self-cooling container apparatus containing a refrigerant receptacle with either expandable or narrowly spaced apart walls for a rapid and efficient transfer of heat out of the container contents.

It is another object of the present invention to provide such an apparatus in which a smaller volume of cold refrigerant is exposed to a larger heat transfer surface area such as by corrugating the refrigerant receptacle wall, to increase the evaporation rate of the liquid refrigerant.

It is still another object of the present invention to provide such an apparatus which both releases refrigerant and opens passage for the container contents with a single action by the consumer.

It is finally an object of the present invention to provide such an apparatus which is inexpensive to manufacture, safe and reliable.

SUMMARY OF THE INVENTION

The present invention accomplishes the above-stated objectives, as well as others, as may be determined by a fair reading and interpretation of the entire specification.

A rapid refrigeration apparatus is provided including a container having a container upper end, a container wall with a container opening in the container upper end bordered by a container rim, the container liquid container contents; a receptacle extending within the container and containing a refrigerant, the receptacle including a cup portion sized to fit into the container opening, a cup flange sized to rest against and sealing secured to, the container rim and a cup wall, at least a portion of which is expandable, the cup wall having cup wall opening mechanism for releasing the container contents into the receptacle;

and a lid sealingly secured to the cup flange and including a lid opening mechanism for releasing the refrigerant from the receptacle into the atmosphere and for releasing the container contents from the receptacle for consumption; the lid opening mechanism including a lid opening mechanism activation mechanism for voluntarily opening the lid opening mechanism at a selected moment in time.

The cup wall opening mechanism preferably includes a cup wall port and a cup wall port plug positioned immediately adjacent to the container wall so that the plug is dislodged from the cup wall port by pressing against and bowing the container wall inwardly. The cup wall opening mechanism includes a cup wall rupture region of sheet material which ruptures upon activation of the lid opening mechanism due to the resulting loss of pressure within the receptacle with the release of the refrigerant and the simultaneous creation of a pressure differential between the interior of the receptacle and the interior of the container outside the receptacle. The expandable portion of the cup wall includes a cone with the cone apex oriented away from the lid and having an undulating cone wall, where the undulations flatten as the cone wall expands.

The lid opening mechanism preferably includes a container contents release port having container contents release port removable closure mechanism and a refrigerant release port having refrigerant release port removable closure mechanism. The refrigerant release port preferably includes an outwardly protruding nozzle portion having a nozzle passageway sized to release a stream of gaseous refrigerant at a release speed which is greater than the gaseous refrigerant combustion speed and where the refrigerant release port removable closure mechanism includes a nozzle passageway plug. The nozzle portion plug preferably includes a plug shaft having a conical nozzle entry tip and a thumb flange for pressing the conical nozzle entry tip into and through the nozzle portion. The thumb flange preferably includes a laterally extending flexible pull tab for gripping to remove the plug shaft from the nozzle passageway.

A rapid refrigeration apparatus is also provided including a primary container having a primary container upper end, a primary container wall having an inwardly beveled primary upper wall portion surrounding a primary container opening, the primary container opening being bordered by a primary container rim; a secondary container smaller than and positioned within the primary container, the secondary container having a secondary container upper end, a secondary container wall having an inwardly beveled secondary upper wall portion surrounding a secondary container opening and having a cup wall opening mechanism, the secondary container opening being bordered by a secondary container rim, so that the secondary container rim rests against and is sealingly secured to the primary container rim and so that an annular refrigerant receptacle chamber is defined between the primary and secondary container walls; refrigerant contained within the annular refrigerant receptacle chamber; liquid container contents in the secondary container; a buoyant sealing cup having a beveled cup side wall tapering toward said secondary container opening and sized to fit sealingly into the inwardly beveled secondary upper wall portion, the cup beveled side wall having at least one cup side wall port; and a lid sealingly secured to the secondary container rim and including a lid opening mechanism for releasing the refrigerant from the receptacle chamber into the atmosphere and for releasing the container contents from the receptacle for consumption; the lid opening mechanism including a lid opening mechanism activation mechanism for voluntarily opening the lid opening mechanism at a selected moment in time; so that activating the lid opening mechanism lowers the pressure of air within the sealing cup to atmospheric causing the pressure between the sealing cup and the remainder of the secondary container to press the sealing beveled cup side wall into sealing contact with the inwardly beveled secondary upper wall portion, and causing the cup wall opening mechanism to open and release gaseous refrigerant through the cup port and into the cup and through the lid opening mechanism into the atmosphere, cooling the container contents; and substantially relieving lateral sealing pressure on the cup wall opening mechanism so that the cup floats and angles away from the lid upon tilting of the apparatus permitting the container contents to flow over and around the cup and out of the apparatus through the lid opening mechanism.

A rapid refrigeration apparatus is further provided, including a primary container having a primary container upper end, a primary container wall having a primary container shoulder portion and a primary container neck portion surrounding a primary container opening, the primary container opening being bordered by a primary container rim; a secondary container smaller than and positioned within the primary container, the secondary container having a secondary container upper end, a secondary container wall having a secondary container shoulder portion and a secondary container neck portion surrounding a primary container opening, the secondary container opening being bordered by a secondary container rim, so that an annular refrigerant receptacle chamber is defined between the primary and secondary container walls; refrigerant contained within the annular refrigerant receptacle chamber; liquid container contents within the secondary container; and a cap removably and sealingly fitted onto the primary and secondary container rims.

The container neck portion is preferably externally threaded and the cap preferably includes a top wall and a cylindrical side wall which is internally threaded, so that the cap side wall engagingly screws onto the container neck portion. The cap preferably additionally includes a cap port and a cap port plug removably and sealing fitted into the cap port for releasing the container contents.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
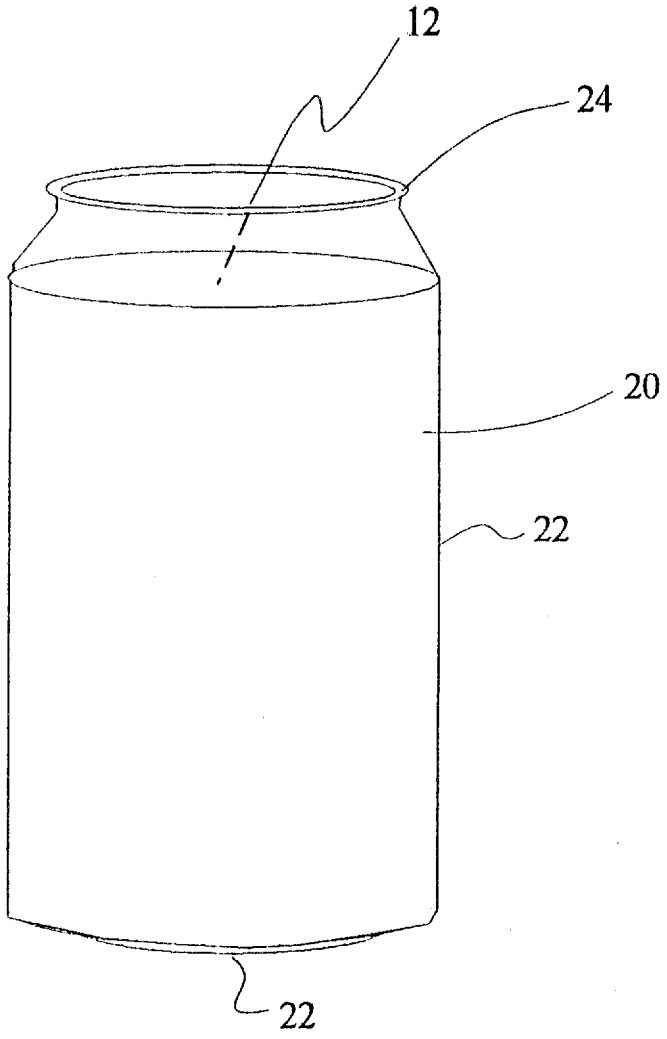
FIG. 1 is a perspective view of a container in the form of a conventional beverage can containing beverage. The container is shown as being transparent for purposes of illustration in this and in many subsequent FIGURES.
Figure 2:
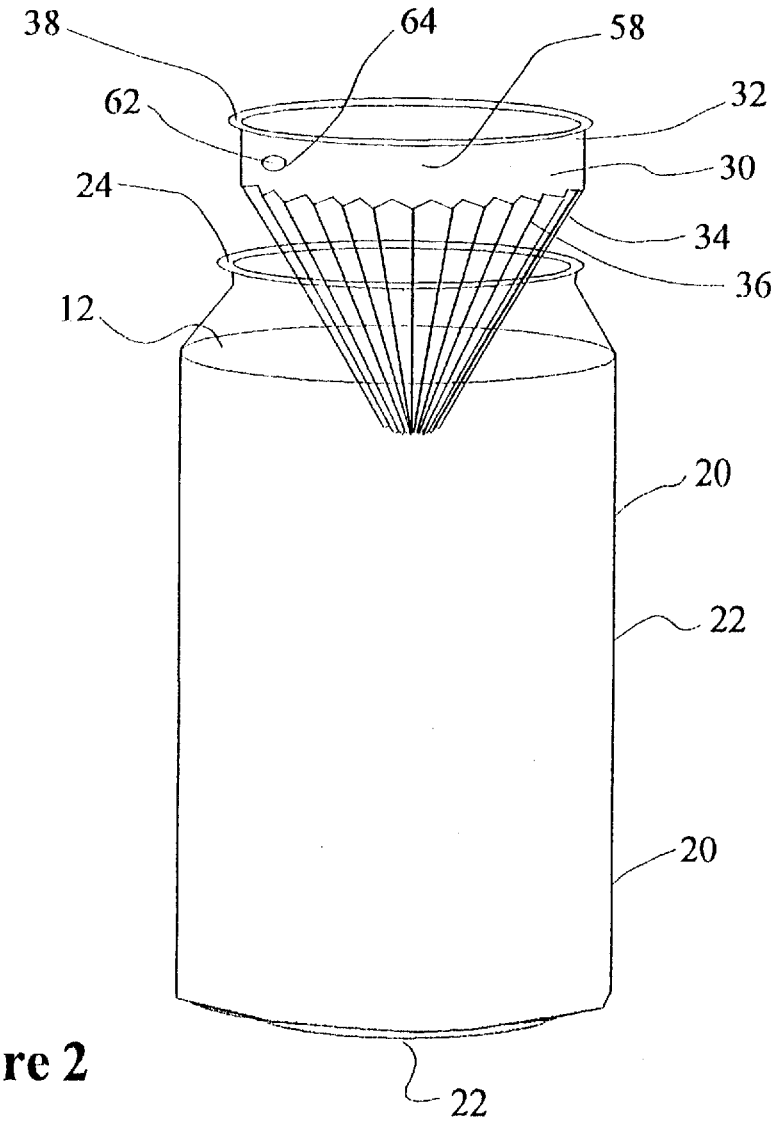
FIG. 2 is a view as in FIG. 1 additionally showing the receptacle cup with expandable side wall portion and beverage passing port and port plug being lowered into the opening at the top of the container.
Figure 3:
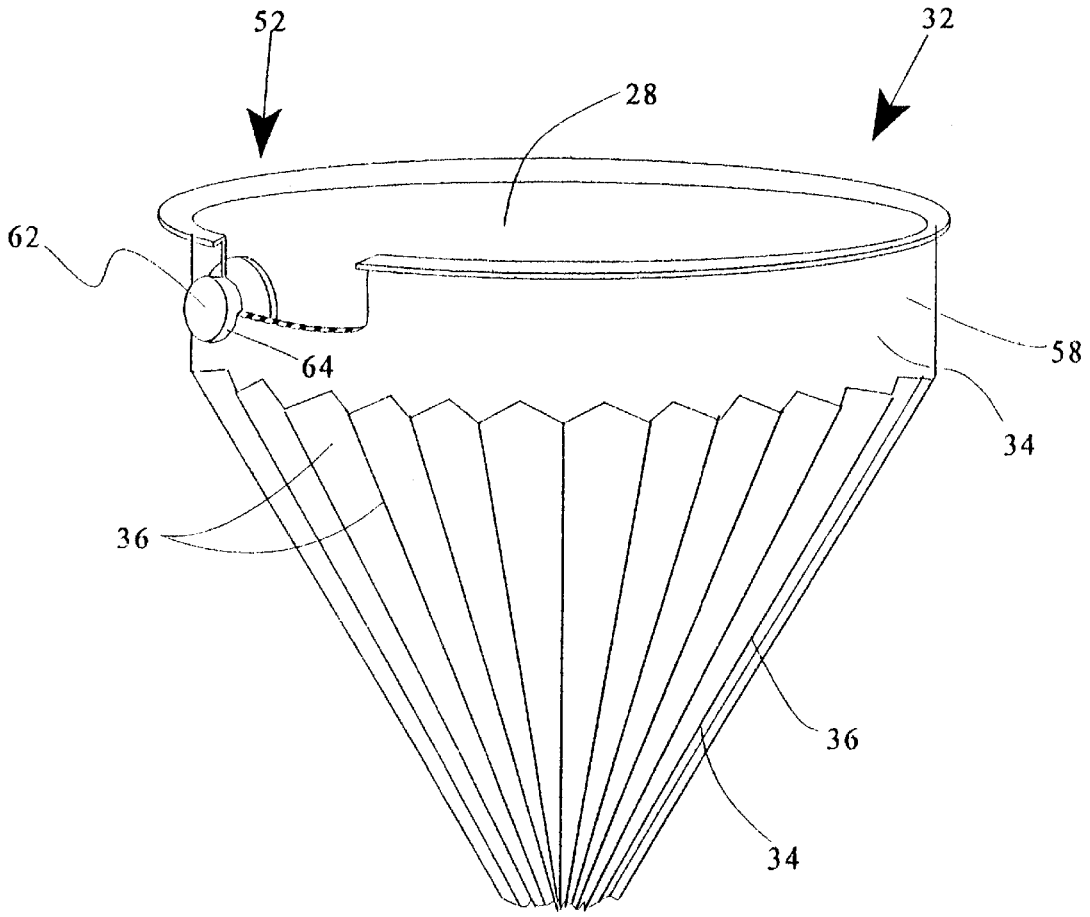
FIG. 3 is a close-up perspective view of the receptacle cup with a portion of the cup rim cut away to reveal the detail of the beverage passing port and plug.
Figure 4:
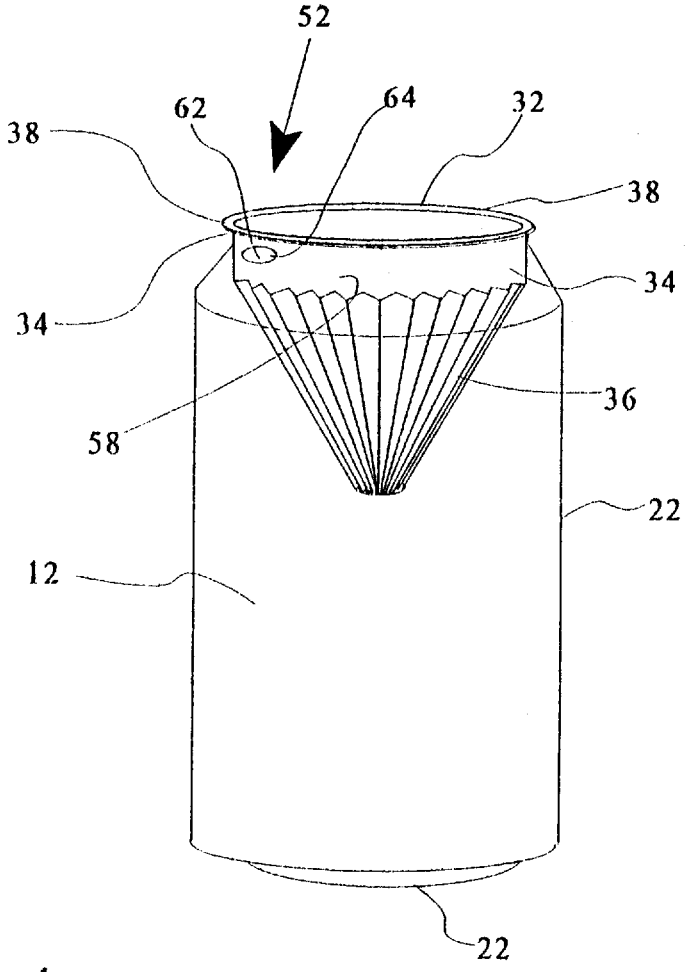
FIG. 4 is a view as in FIG. 2 with the receptacle cup fully lowered into the container, with the cup rim resting on the container rim.
Figure 5:
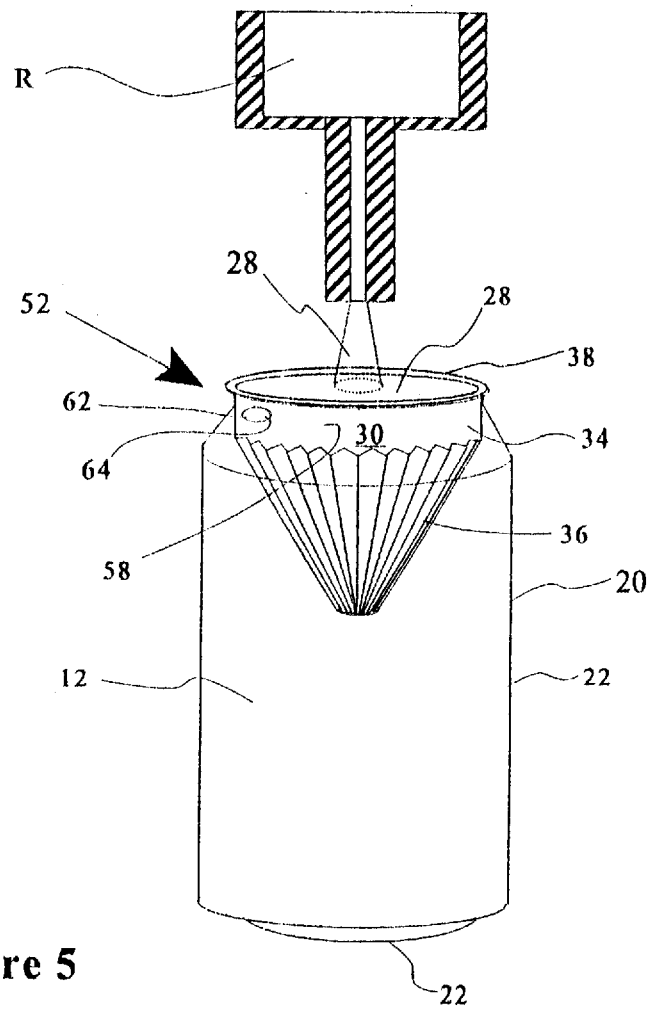
FIG. 5 is a view as in FIG. 4 showing the cup being charged with refrigerant from a refrigerant dispenser R.
Figure 6:
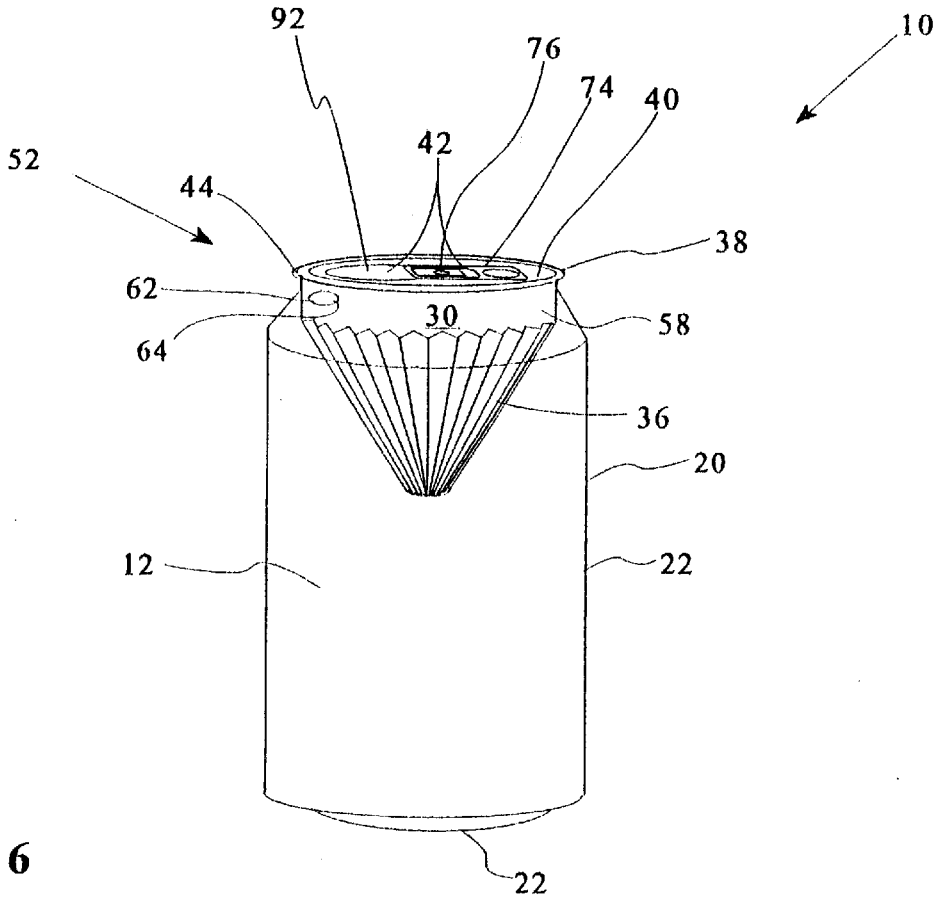
FIG. 6 is a view as in FIG. 5 with a container lid in place, the lid lateral edge resting on the cup rim and ready for crimping.
Figure 7:
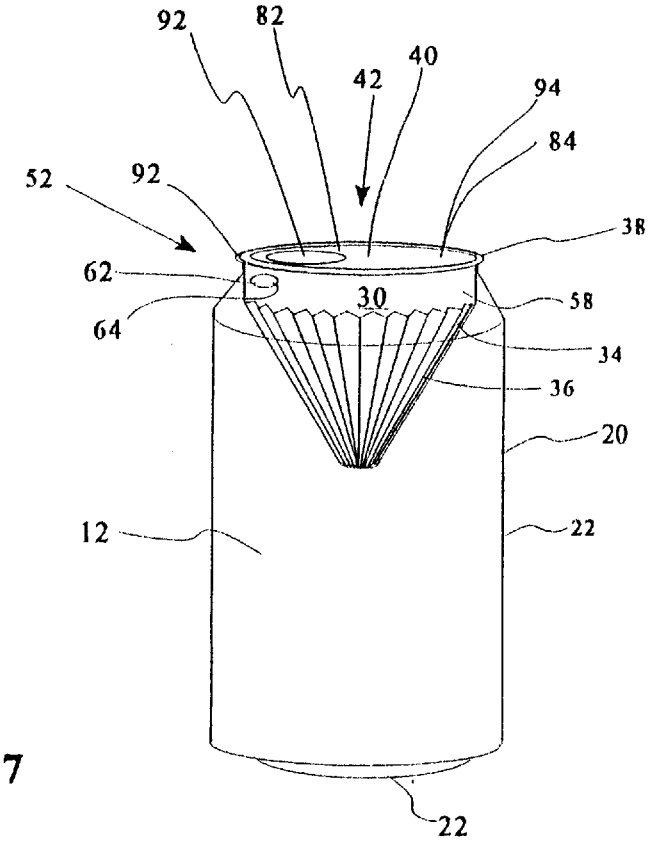
FIG. 7 is a view as in FIG. 6 showing an alternative lid opener mechanism including the large beverage passing port and sealing disk and the smaller refrigerant passing port.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–11, a self-cooling container apparatus 10 containing a beverage or other food item 12 is disclosed, as well as apparatus 10 assembly and operation methods.

Apparatus 10 includes a container 20 such as a can containing a beverage 12 and having a conventional unified bottom and side container wall 22 terminating in a container rim 24 defining a container opening. A receptacle 30 is provided containing a refrigerant 28 and including a receptacle cup 32 having a cup wall 34 with an expandable portion 36 and having a cup rim 38 which extends laterally from the cup wall 34 at the container opening. A conventional beverage can lid 40 is further provided, including a lid panel with a lid opener mechanism 42 and a lid lateral edge 44.

Method of Operation

Opening the lid opener mechanism 42 releases the refrigerant 28 vapor initially present within receptacle 30 and the remaining liquid refrigerant 28 progressively boils into a vapor state and rapidly escapes through opener mechanism 42. As refrigerant 28 boils and evaporates, it draws heat out of the beverage 12 through cup wall 34. Once all of the refrigerant 28 has been released, cup wall 34 is opened with a cup wall opener mechanism 52 to permit beverage 12 to flow into cup 32 and then out of container 20 through lid opener mechanism 42.

Method of Assembly

The method of manufacture includes the steps of lowering the cup 32 part way through container rim 24 so that cup 32 displaces some of beverage 12 in container 20; placing cup rim 38 on container rim 24; placing lid 40 on top of cup 32 so that lid lateral edge 44 rests against cup rim 38; and crimping lid lateral edge 44 and cup rim 38 onto container rim 24. Either before or after the lid 40 is placed onto cup 32, a refrigerant 28 chilled to a liquid state is placed inside into cup 32. After crimping, the refrigerant 28 warms to ambient temperature together with the remainder of apparatus 10, partially evaporates and develops internal pressure against cup wall 34 and lid 40.

The cup wall 34 expandable portion 36 expands and transmits this developed pressure against beverage 12, which in turn transmits the pressure to container wall 22. Container wall 22 and lid 40 are designed to withstand pressure well beyond this level. Furthermore, cup wall 34 is sized and provided with expansion capacity relative to the head space above beverage 12 within container 20 so that cup wall 34 reaches equilibrium pressure with beverage 12 and container wall 22 before reaching its maximum expansion, so that cup wall portion 36 is not loaded in tension and will not rupture.

It is preferred that receptacle 30 be charged with refrigerant 28 prior to closing receptacle 30 and crimping the apparatus 10 together. An alternative approach is provided, however, in which beverage 12 is placed in container 20, lid 40 is crimped onto container 20 and the refrigerant 28 is placed into receptacle 30 subsequently. In this event, after the crimping process is completed, container 20 and its contents are transported to a separate processing station where liquified refrigerant 28 is charged into receptacle 30 under pressure at ambient temperature. This alternative approach presents the advantage of separating the refrigerant 28 charging process from the apparatus 10 manufacturing process.

Figure 8:
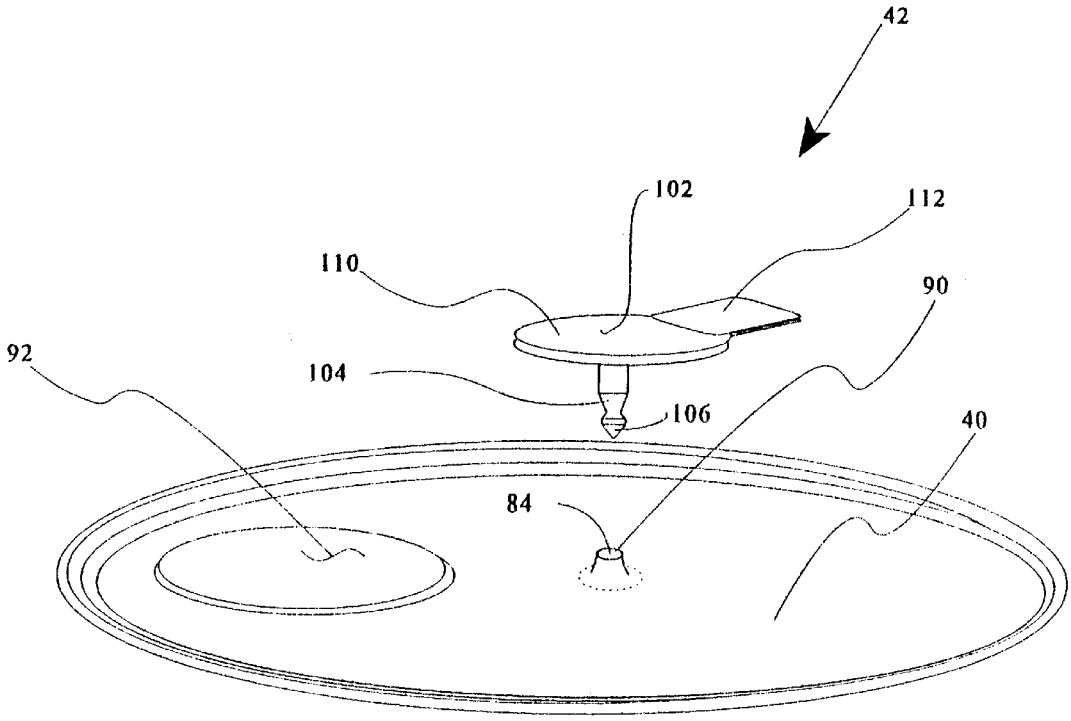
FIG. 8 is a close-up of the lid and opener mechanism with a preferred nozzle provided around the small refrigerant passing port, showing the preferred nozzle closing stem and tab structure.
Figure 9:
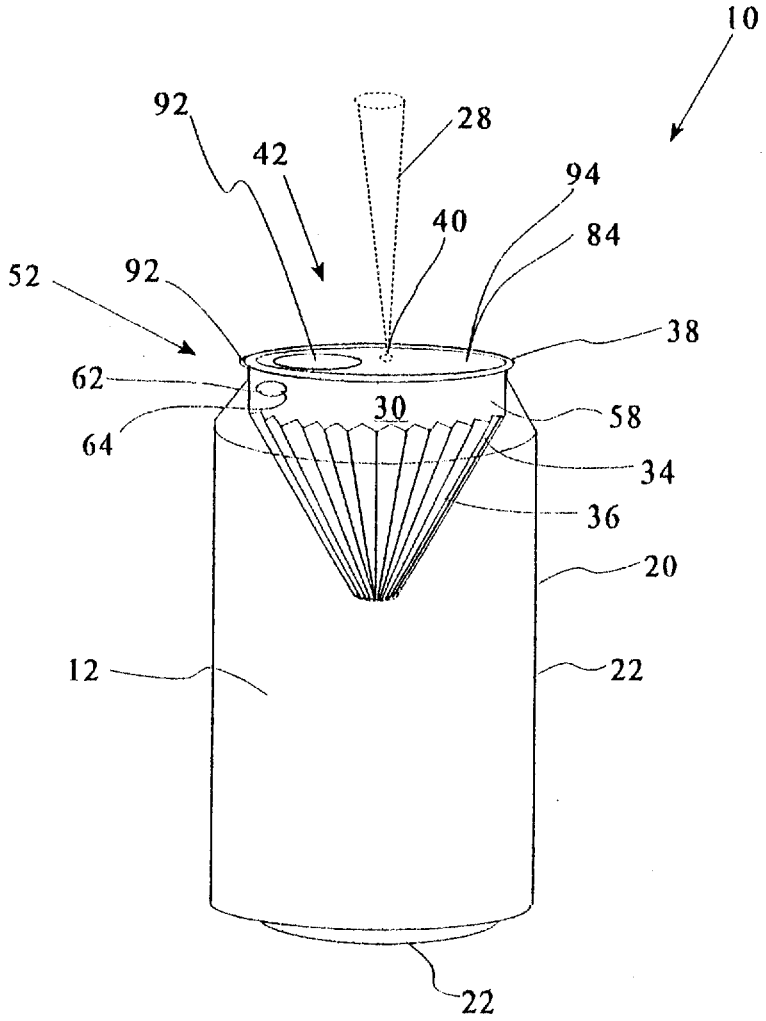
FIG. 9 is a view as in FIG. 7 with the closing stem and tab structure removed from the small port and a plum of gaseous refrigerant escaping into the atmosphere.

Refrigerant 28 enters receptacle 30 through a nozzle 50 shown in FIG. 8. In accordance with conventional refrigerant charging methods, the charger valve (not shown) mates with nozzle 50 and forms a seal. Liquified refrigerant 28 is then introduced into receptacle 30 through nozzle 50. Upon completion of charging of the liquified refrigerant, the nozzle 50 passageway is plugged and sealed by a sealing mechanism.

An option step is to charge the refrigerant 28 with a small amount of cryogenically cold $LCO_2$ (liquid carbon dioxide) or $LN_2$ (liquid nitrogen). The combined mixture is poured into receptacle 30 just before receptacle 30 is inserted into container 20. As containers 20 travel to the receptacle 30 insertion station, and then to the beverage or food 12 filling station, the cold cryogenic fluid evaporates slowly, supercooling the refrigerant 28. Thus the refrigerant 28 remains in liquified form throughout the manufacturing process with very little being lost to evaporation.

It is important that the amount of $LCO_2$ or $LN_2$ used be calibrated exactly. The evaporation of the $LCO_2$ or $LN_2$ should be completed by the time the container 20, receptacle 30 and lid 40 are crimped together. This is because the pressure of an excessive quantity of the $LCO_2$ or $LN_2$ could be very high and could result in the rupture of container 20 after a period of time when its vapor pressure increases beyond the pressure limit of the container 20.

Structural Variations

It is preferred that cup wall 34 be formed of a flexible material such as foil or a suitable plastic and that cup wall 34 be undulated about its lateral circumference. As the cup wall circumference expands to the point of equilibrium, the undulations partially flatten. The cup wall 34 upper end is preferably a non-expandable ring portion 58 integral with the lower expandable portion 36.

Cup wall opener mechanism 52 is optionally a circumferential series of plugs 62 fitted sealingly into corresponding plug ports 64 in cup wall ring portion 58. The plugs 62 may be pushed out of ports 64 and into the cup 32 by the consumer squeezing adjacent portions of container wall 22 against plugs 62. Plugs 62 may also be dislodged automatically by the pressure imbalance caused by the sudden decrease of pressure within the receptacle 30 upon operation of the lid opener mechanism 42 and the sustained above-ambient pressure of the beverage 12 outside the receptacle 30. Alternatively the cup wall ring portion 58 is provided with a circumferential series of thin portions 66 which rupture inwardly with the sudden pressure imbalance, permitting beverage 12 to enter cup 32 and then to exit container 20 through lid opener mechanism 42.

Lid opener mechanism 42 may be an ordinary pull tab or a trap door region 72 defined by a stress riser groove which is depressed and torn free to pivot into cup 32 by a lever 74 pivoting on a rivet 76. Another suitable lid opener mechanism 42 is a port and disk ECO-TOP™ opener mechanism. Lid 40 is provided with a large port 82 and a small port 84. Small port 84 is sealed with a sealing disk 94 slightly larger than small port 84 and placed underneath small port 84 to form a breakable seal with small port 84. Disk 94 is pressed down into receptacle 30 to release the gaseous refrigerant 28. By the same token, large port 82 is breakably sealed with a slightly larger sealing disk 92 underneath. The disk 92 is pressed down into receptacle 30 to release the beverage 12 flowing into cup 32 following the evaporation of refrigerant 28. Large disk 92 can be depressed by a consumer finger.

Another lid opener mechanism 42 is inventively provided including a large port 82 as described immediately above and a small port 84 shaped to define an upwardly protruding, narrow safety nozzle 90. Nozzle 90 is sized and configured to release gaseous refrigerant 28 in a narrow stream at a speed higher than the combustion speed of the refrigerant 28, so that a flame cannot advance into receptacle 30 in the event that the stream is accidently ignited. Furthermore, for the reasons stated below, the stream is believed to be incapable of ignition. As a result, safety nozzle 90 makes possible the use of common inflammable refrigerant mixtures, such as butane, propane, 152A, or dimethylether. Safety nozzle 90 is fitted with a resealable plug 102 so that subsequently poured beverage 12 does not dribble out of nozzle 90. Resealable plug 102 preferably includes a plug stem 104 having a conical flare 106 at its tip for snapping through the nozzle 90 passageway and seating under the lid 40. Plug 102 is preferably connected to the underside of a disk flange 110, and a laterally protruding flexible pull tab 112 is secured to disk flange 110.

Once again the lid 40 is secured to container 20 by crimping its lateral edge 44 onto the container rim 24 with a conventional crimping machine. Since the crimping equipment and procedure are conventional, any existing crimped lid 40 design may be used without modification to the lid. A conventional pull tab lid 40 may be used directly with the assembly to achieve the desired purpose of creating separate beverage 12 and refrigerant 28 chambers within container 20.

Plug 102 may be formed of a flexible plastic material and the conical flare 106 is preferably of slightly greater diameter than the nozzle 90 passageway, so that conical flare 106 freely slides through the nozzle 90 and then expands to form a seal underneath the lid 40. Nozzle 90 is formed during the manufacture of lid 40 with a specially designed puncher pin (not shown) attached to a stamp (not shown) used to stamp the lid 40 out of sheet material. An alternative plug 102 design is simply a mass within the nozzle 90 passageway formed by smearing molten plastic over the nozzle 90 so that the plastic assumes a sealing shape.

Operational Characteristics

As liquid refrigerant 28 boils into a vapor state and exits receptacle 30, the refrigerant 28 extracts and carries away heat from the beverage 12. During this process, the pressure of the liquid phase of refrigerant 28 is greater than one atmosphere and the receptacle 30 remains partly expanded. As the pressure of refrigerant 28 falls due to rapid self-cooling, cup wall expandable portion 36 relaxes and the weight of the beverage or food product 12 surrounding cup 32 urges the receptacle 30 to a smaller volume. This reduction in volume causes the cold liquified refrigerant 28 to be squeezed and urged into contact with a larger surface area of the receptacle 30. Cup wall 34 then transfers more heat from the beverage 12 to the cold liquified refrigerant 28. This enhances evaporation of the refrigerant 28. The increased heat absorption results in an increase in the rate of evaporation. This increase in the rate of evaporation produces more refrigerant 28 gas with receptacle 30 and thus causes the pressure of the refrigerant 28 to increase. The increase in pressure within receptacle 30 causes receptacle 30 to again expand its volume. Once again, as self-cooling of the liquified refrigerant 28 occurs, the cycle repeats. This rapid cyclic variation in receptacle 30 volume causes the refrigerant 28 to evaporate at a higher rate than would be expected if refrigerant 28 were evaporating within a rigid receptacle of fixed volume.

Figure 10:
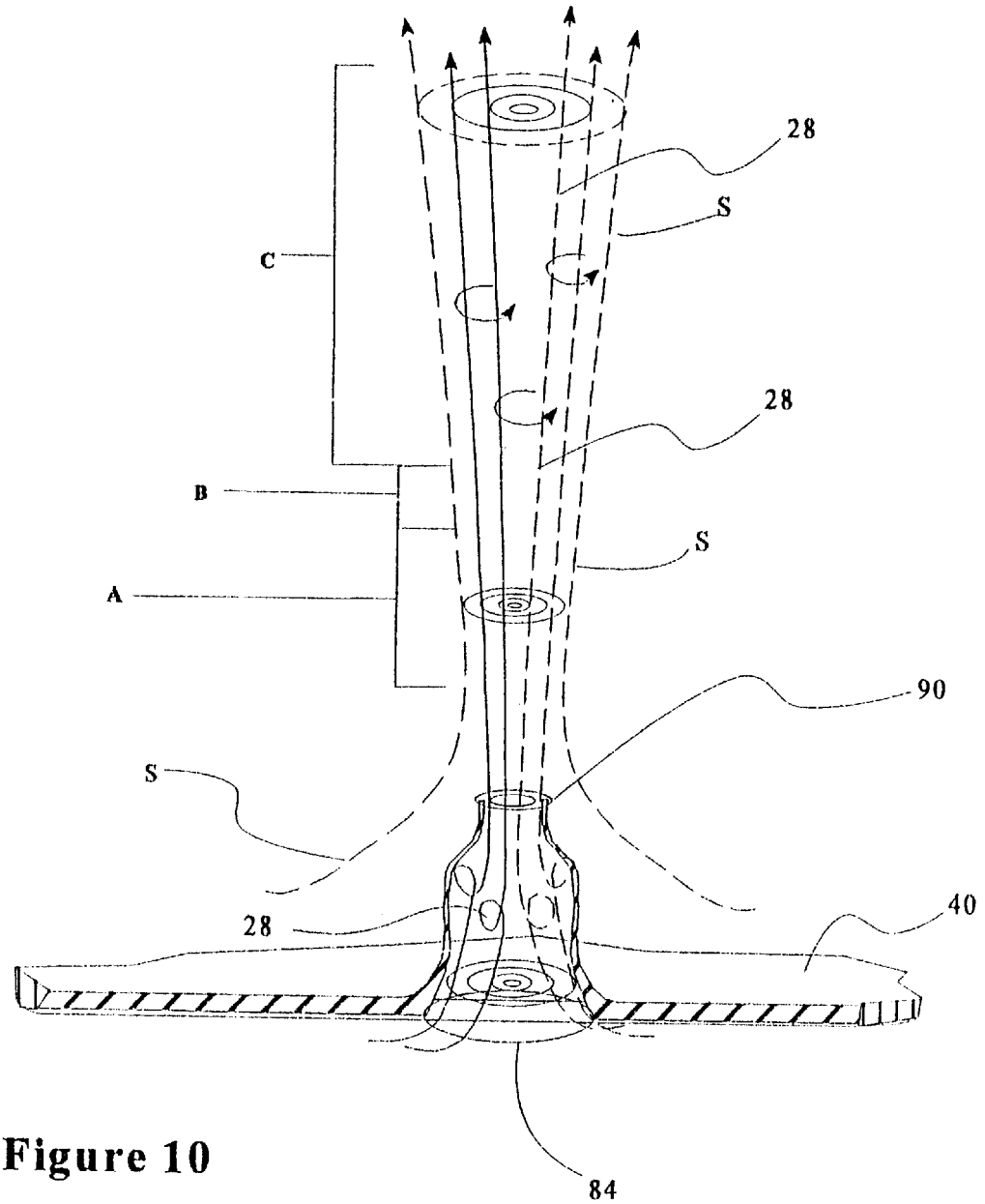
FIG. 10 is a schematic representation of the gaseous refrigerant plum of FIG. 9 showing the three plum regions discussed in the text.

As indicated generally above, upon removal of the plug 102, the nozzle 90 causes the gaseous refrigerant 28 to exit at a high speed, exceeding thirty feet per second. See FIG. 10. During the refrigerant 28 exit from nozzle 90, eddies are formed by rapid recirculation of the gas 28 within nozzle 90 as the gas 28 is forced to exit the nozzle 90. If an inflammable gas 28 mixture is to be used, the nozzle 90 is designed with an exit passageway (not shown) with a width on the order of one millimeter to two millimeters in diameter. According to the ideal gas law:

$$\frac{P}{\rho} + \frac{v^2}{2} = K(\text{constant}),$$

where P is the pressure difference between the gas 28 within the receptacle 30 and atmospheric pressure, ρ is the gas 28 density, and v is the velocity of the gas 28 stream. The velocity of the exiting gas 28 will depend on the internal pressure of the gas 28 exiting the nozzle 90. The velocity of the exiting gas 28 can be controlled accurately by selecting the size of the nozzle 90 passageway in order to maintain a given pressure and a fixed evaporation rate. The mass flow rate of the gas 28 will be approximately constant, barring the oscillation of the pressure due to the volume variation cycle described earlier. Thus, by varying the nozzle 90 passageway diameter, the velocity of the exiting gas 28 is controlled accurately for each gas 28 mixture. During the rapid exit of the gas 28, a vacuum is created peripherally around nozzle 90. This vacuum results in air being pulled uniformly around the cone of the expanding gas 28 mixture. As shown in FIG. 10, the cone of air S thus formed around the gas 28 stream forms a flame barrier around the gas 28 stream.

In FIG. 10, region A is a region where the gas/air mixture is fuel rich. This fuel rich mixture in region A is also surrounded by a rapid flow of air, which prevents any possibility of combustion of the gas mixture since the percentage of fuel in the gas 28 stream in air exceeds the upper and lower explosion limits (LEL) and (UEL) of the gas 28 mixture. Thus if a naked flame such as a butane torch or a cigarette lighter were placed adjacent to region A, the flame would be extinguished immediately. Also the speed of the gas 28 stream is so high that it exceeds the gas flame speed, so that no combustion can be sustained in region A.

Region B is a region in which a flame may momentarily form. Yet because of the rapid motion and turbulence that results from air mixing with gas 28, a flame or combustion within region B cannot be sustained. Region B is a very small region, and is localized to a very short period of time, during which no flame can survive the transition. Also the air barrier thus formed around region B, forces the outer skirt of the gas 28 stream to be air-rich and thus non-inflammable, and the interior of region B forces the gas 28 stream to be fuel-rich and thus non-inflammable. Thus the outer skirt of the gas stream has a percentage of fuel below the required lower explosion limit (LEL) of the gas 28, and the interior of region B has a percentage of fuel far greater than the upper explosion limit (UEL) required to maintain gas 28 combustion.

Figure 11:
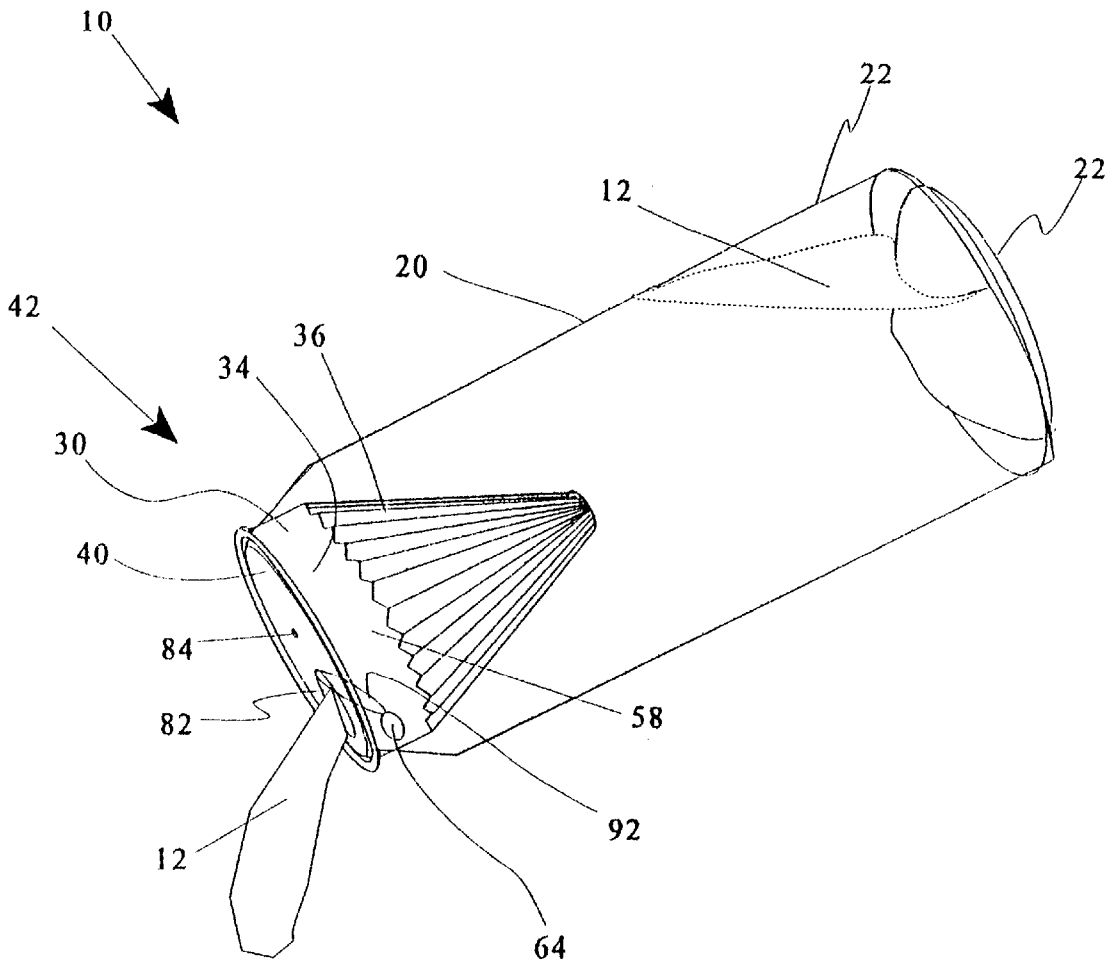
FIG. 11 is a view of the container in a tilted position and with the beverage passing port open, with beverage pouring out for consumption.
Figure 12:
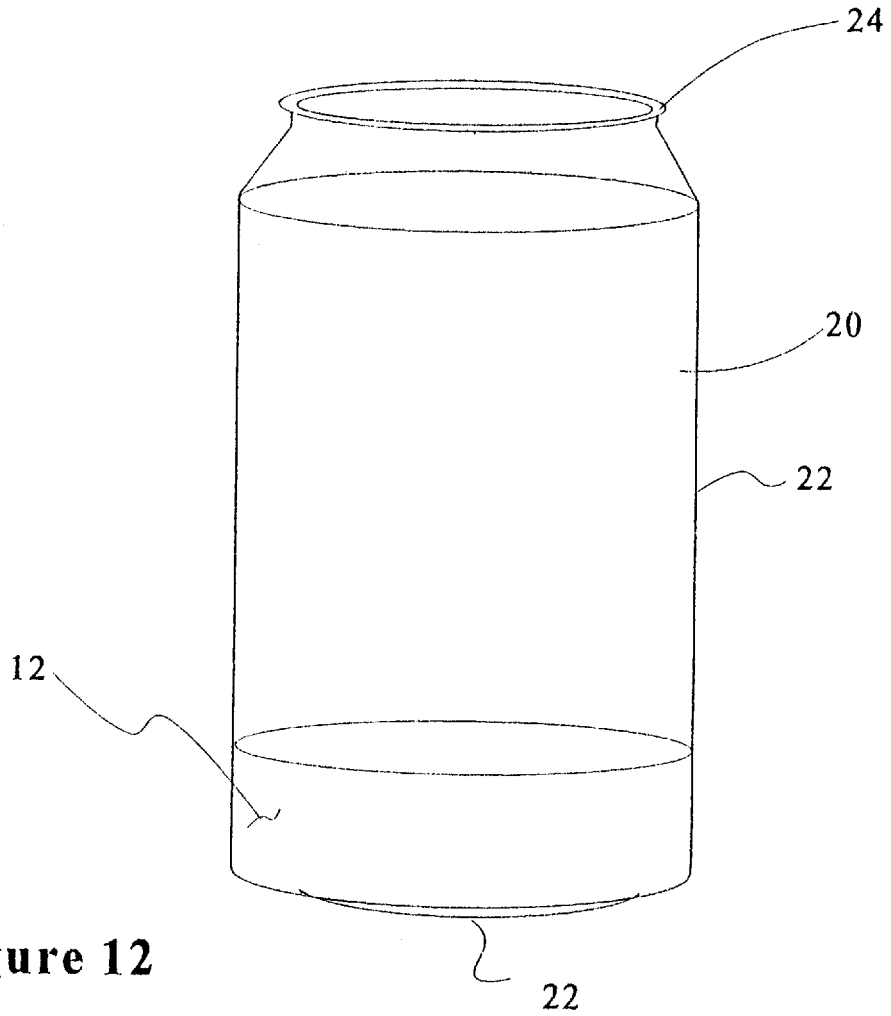
FIG. 12 is a view as in FIG. 1.
Figure 13:
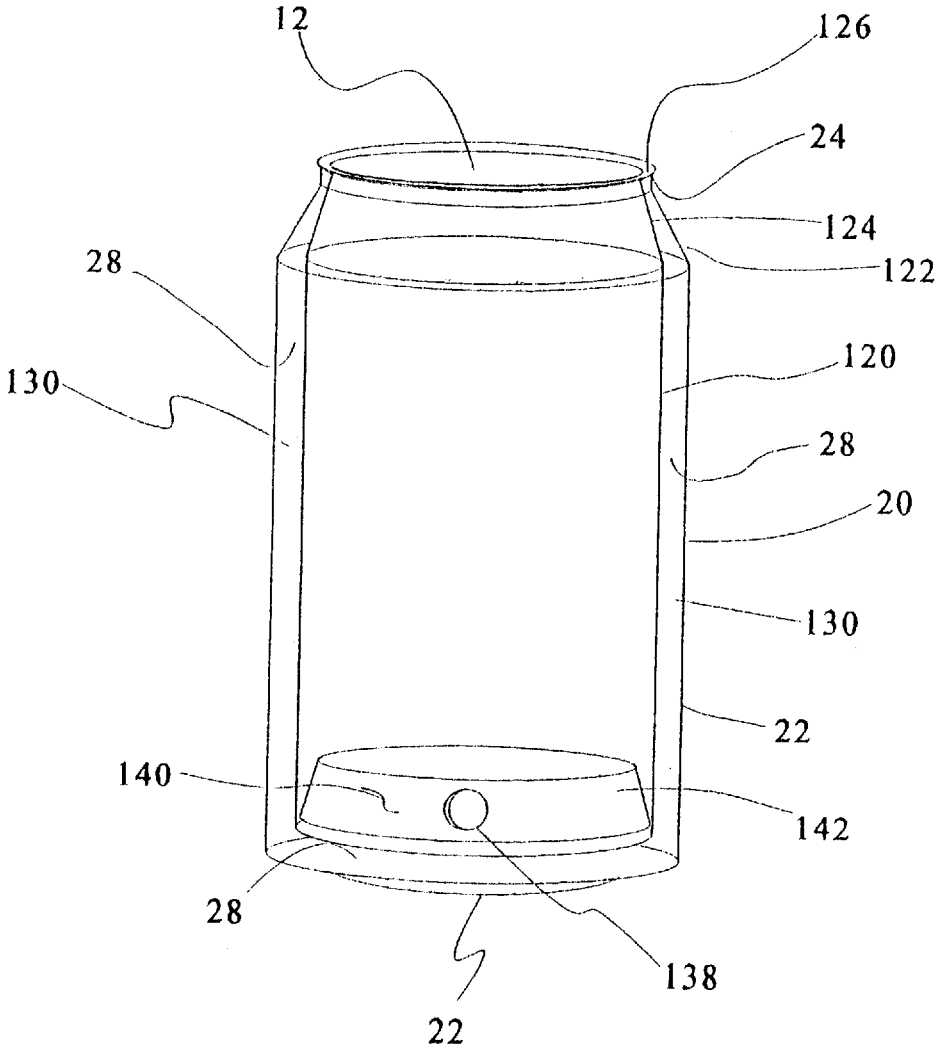
FIG. 13 is a view as in FIG. 12 with the secondary vessel inside the container and the sealing cup resting at the bottom of the vessel. A cup port is also shown.
Figure 14:
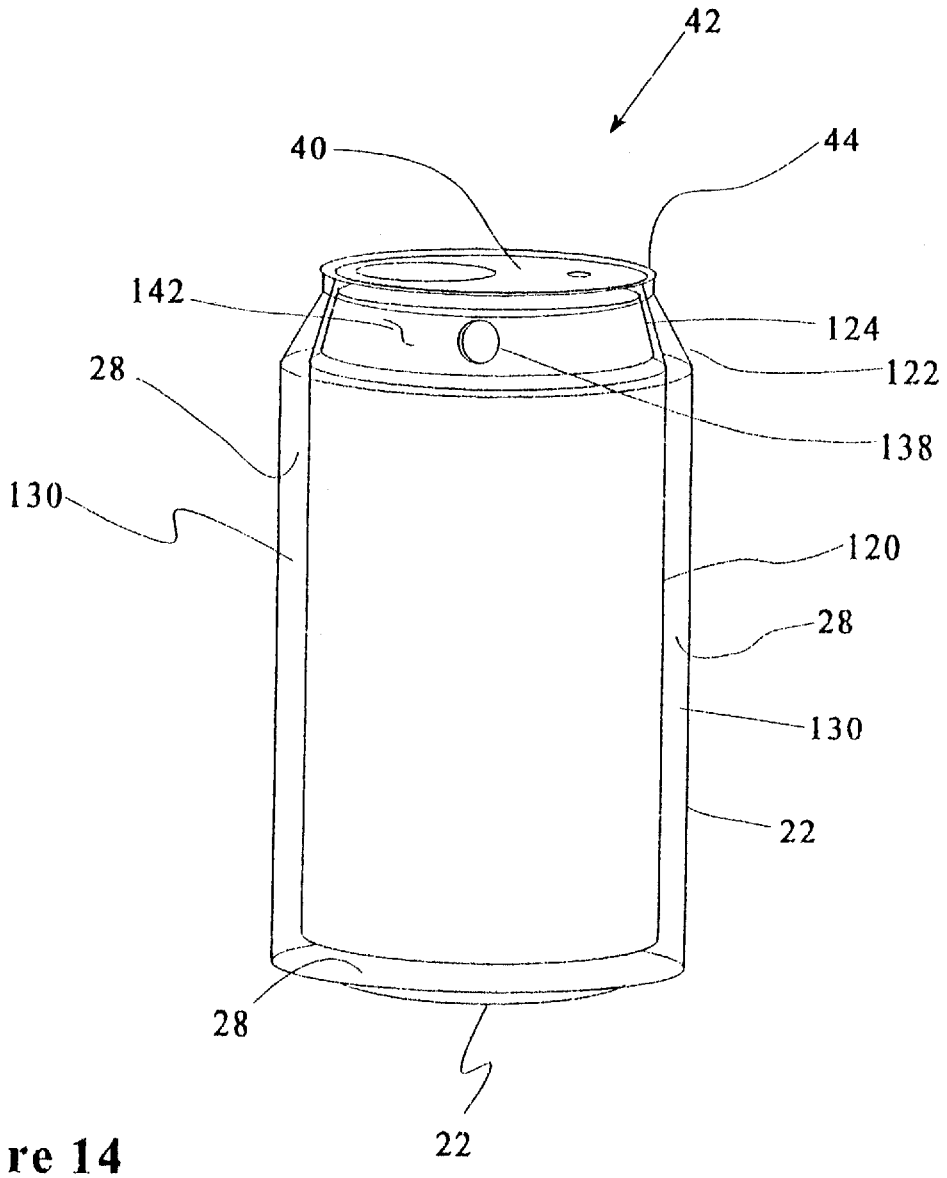
FIG. 14 is a view as in FIG. 13, except that beverage has been added so that the sealing cup has floated to the vessel upper end where its beveled side wall seals against the inside of the vessel beveled shoulder portion.
Figure 15:
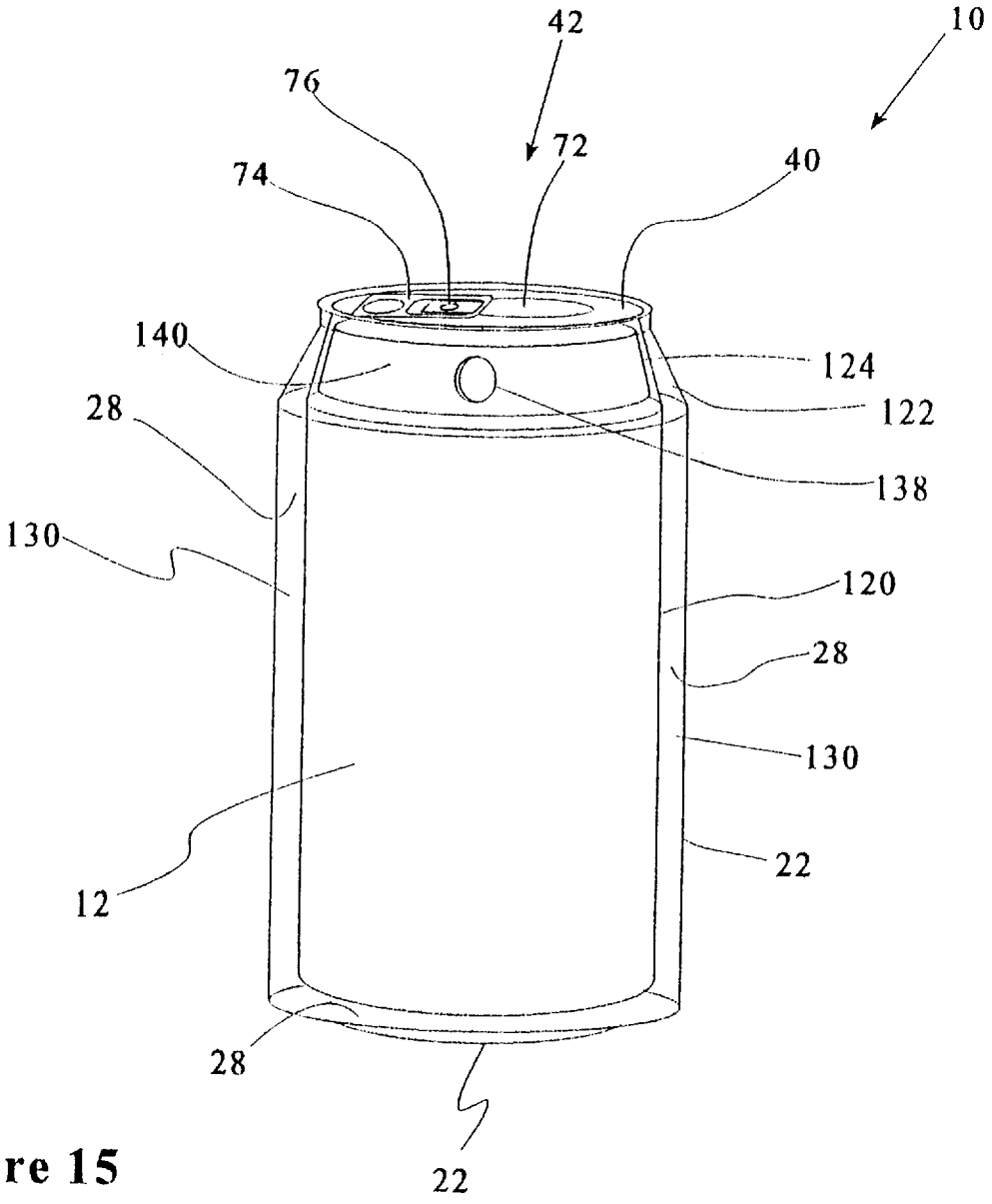
FIG. 15 is a view as in FIG. 14 with the container lid added.

By the time the gas 28 mixture reaches region C, it is too diluted by the air stream to be inflammable. Thus the LEL of the gas 28 exceeds the percentage of fuel in air required to maintain combustion. FIG. 11 shows a container that has been cooled and opened for consumption.

Second Preferred Embodiment

The second embodiment includes container 20 of the first embodiment, with a similarly shaped and slightly smaller inner vessel 120 fitted inside. See FIGS. 12–16. Both container 20 and vessel 120 have beveled shoulder portions 122 and 124, respectively. The vessel rim 126 of the inner vessel 120 has a lateral flange which rests on container rim 24 of the inner vessel 120, and an annular space 130 is defined between container 20 and vessel 120 for retaining refrigerant 28. Inner vessel shoulder portion 124 is formed of thin and fragile material, and the entire inner vessel 120 may be formed of the same thin material, such as aluminum foil or blow molded plastic material. A beveled sealing cup 140 is provided and formed of a buoyant plastic, having radial cup ports 138 opening into its beveled side wall 142. The bevel angle of the side wall 142 corresponds to the bevel angle of the inner vessel shoulder portion 124. A container lid 40 of conventional design, preferably having a lid opener mechanism 44 is provided having a lateral edge 44 which is crimped together with the container rim 24 inner vessel rim 126. Cup 140 may also be constructed to be pre-attached directly to the under-side of the lid 40 prior to the crimping process. In such a case the cup 140 is designed so as not to interfere with the usual stacking of the unattached lids 40 within the conventional crimping equipment.

Method of Assembly

In manufacturing apparatus 10, it is preferred that refrigerant 28 first be introduced into container 20 and then inner vessel 120 be fitted into container 20 until the rims 24 and 38 meet. Then cup 140 is fitted into inner vessel 120 so that cup 140 rests on the bottom of inner vessel with the open, narrower cup 140 end directed upwardly. Beverage or other food product 12 is then introduced into inner vessel 120 according to conventional filling procedures. As the beverage 12 level rises within the inner vessel 120, the buoyant cup 140 floats to a level within inner vessel 120 beveled shoulder 124. See FIG. 14. Then the lid 40 is placed on the two upper rims 24 and 38 and the lid lateral edge 44 and crimped together in a conventional way with existing crimping equipment. See FIG. 15. Lid 40 may be the ECO-TOP™ lid described previously.

Method of Operation

Figure 16:
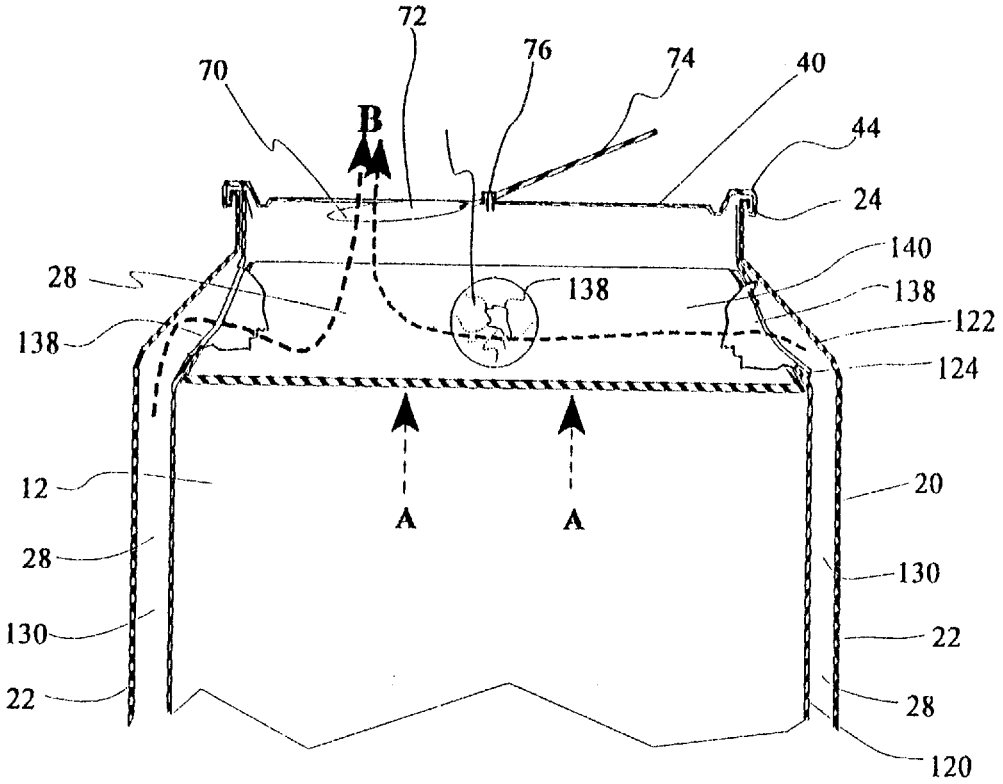
FIG. 16 is a schematic cross-sectional view of the container upper end showing conditions immediately after the lid opener mechanism has been opened, with the cup sealingly pressed against the vessel beveled shoulder portion and the refrigerant having ruptured the thin vessel shoulder region and passing through the cup ports.

FIG. 16 illustrates what happens when the tab 74 is opened by the consumer. When tab 74 is pulled, disk 72 breaks away and port 70 is created for passage of the beverage or food product 12. As the vessel 120 walls are exposed to atmospheric pressure, a force evidenced by arrows A is created which tends to compress vessel 120 and to force the beverage 12 level to rise toward the drink port. Sealing cup 140 now forms a seal with beveled shoulder portion 124. The pressure of refrigerant 28 against beveled shoulder portion 124 causes shoulder portion 124 to tear through into the radial cup ports 138 in beveled side wall 142 of cup 140. Thus refrigerant 28 gases can freely escape through the port 70 on the lid 40 as indicated by arrows.

The sealing cup 140 is lifted by pressure and forms a seal beneath the lid and against beveled shoulder portion 124 preventing any beverage 12 from escaping. The refrigerant 28 is thus free to evaporate from container 20. The evaporating refrigerant 28 cools beverage 12. Upon completion of the cooling process, the pressure of the refrigerant 28 falls to atmospheric pressure, and the pressure acting on the sealing cup 140 is relieved. When container 20 is tilted for consumption, the sealing cup 140 is free to float away from its sealing position, permitting passage of beverage 12 for consumption.

Third Preferred Embodiment

Figure 17:
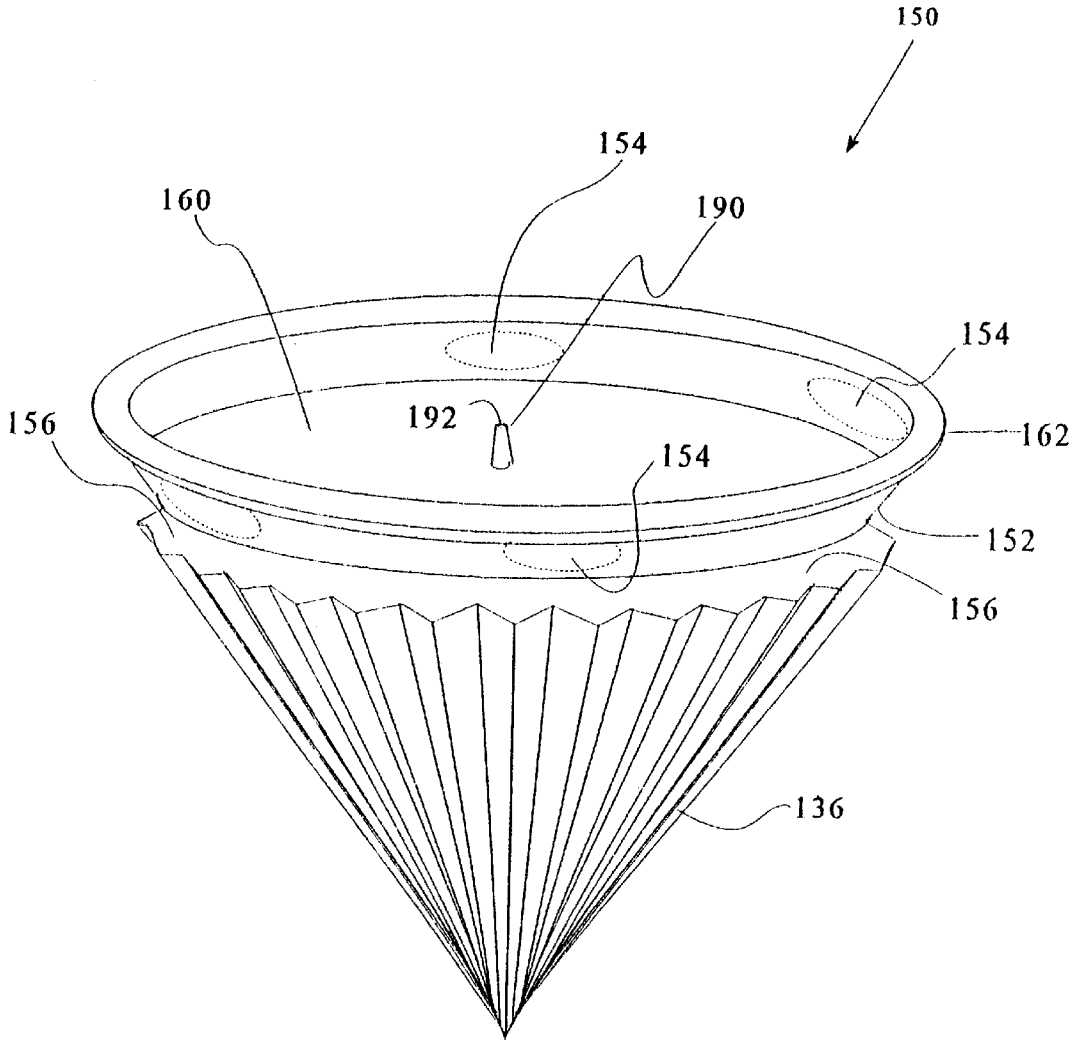
FIG. 17 is a perspective view of the refrigerant receptacle of the third embodiment, having the lid piercing nozzle and upper wall which in combination with the lid defines an additional chamber.
Figure 18:
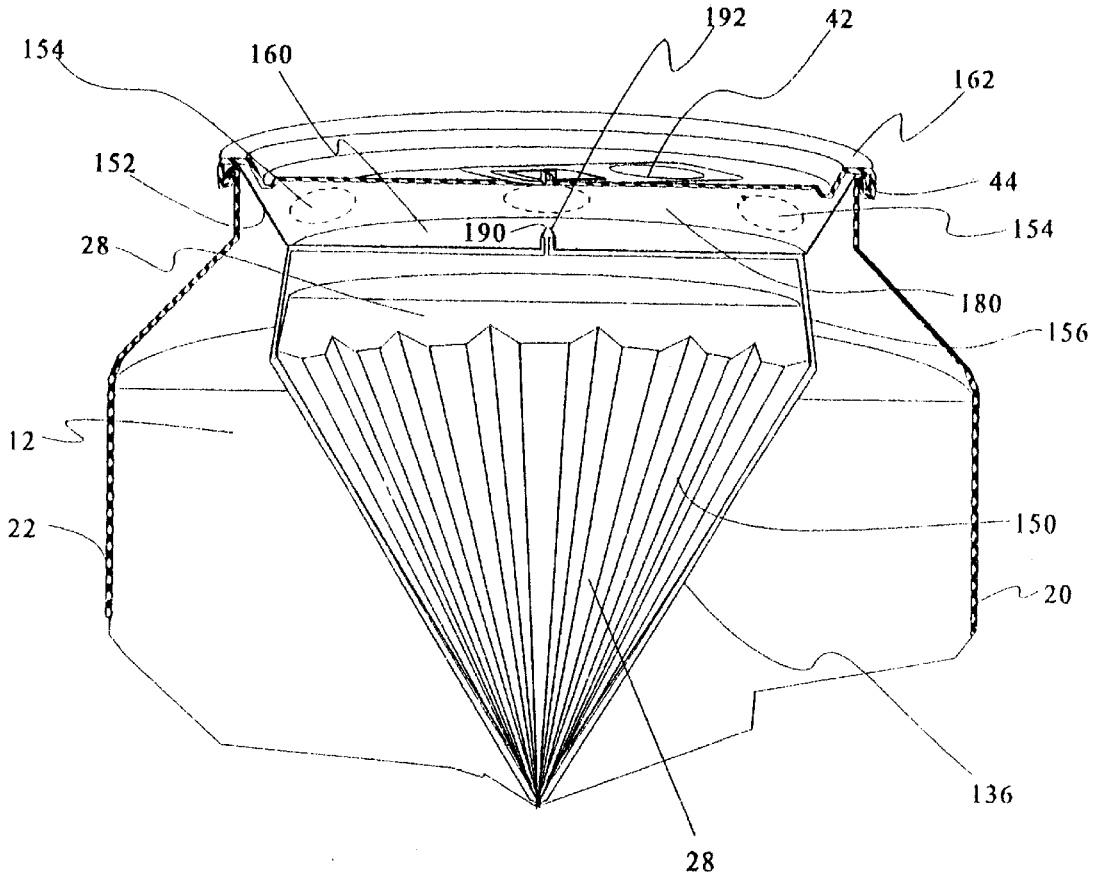
FIG. 18 is a cross-sectional side view of the refrigerant receptacle of the third embodiment installed in a container.

An expandable receptacle is provided which is similar in construction to the receptacle 30 of the first embodiment. See FIGS. 17–19. The receptacle 150 has the conical undulating side wall expandable portion 136 and a cylindrical upper side wall segment 152 with weakened regions 154 for pressure differential rupture as previously described, and has a non-tearing cylindrical side wall segment 156 between the expandable portion 136 and the upper side wall portion 152. A receptacle top wall 160 is additionally provided at the intersection of cylindrical side wall segments 152 and 156. Top wall 160 is made of flexible but rupture-resistant sheet material, and includes a centrally located, upwardly directed nozzle 190 generally as described for the first embodiment, but having a tapered lid-piercing upper tip 192. Upper cylindrical side wall portion 162 terminates in a laterally extending receptacle flange 162 which is sized to rest on top of container rim 24. A conventional lid 40 preferably having a lid opener mechanism 42 and a circumferential lid lateral edge 44 is fitted on top of container 20 so that the lid lateral edge 44 rests on the receptacle flange 162. The lid lateral edge 44, receptacle flange 162 and container rim 24 are then crimped together in the conventional way with known crimping equipment. This construction defines an upper chamber 180.

Before crimping, container 20 is first filled with beverage 12. Then receptacle 150 is charged with the liquid refrigerant 28 through the nozzle 190 at a charger-inserter station (not shown). Nozzle 190 is open so that the refrigerant 28 is left to partially evaporate as the receptacle 150 is inserted into the filled container 20. Lid 40 is then crimped together with the combined receptacle flange 162 and container rim 24, while evaporation of the refrigerant 28 momentarily takes place through the nozzle 190. As the crimping is completed, the evaporating refrigerant 28 starts to build up pressure and the receptacle 150 walls start to expand. The expanding receptacle 150 now exerts pressure on the food or beverage product 12, which in turn exerts pressure on the container wall 22. The three soon come into equilibrium, and the pressure driving the expansion of receptacle 150 subsides. At this stage, no pressure stresses exist on the receptacle 150 walls. All pressure stresses have been transferred to container wall 22, which is preferably designed to withstand up to 100 pounds per square inch (psi).

The nozzle 190 passageway connecting chamber 180 and receptacle 150 is of very small diameter, so that the liquid refrigerant 28 contained in the receptacle 150 will not substantially escape into the chamber 180. Furthermore only a minute amount of refrigerant 28 will have evaporated from receptacle 150 prior to the crimping of the lid 40 with the combined receptacle flange 162 and container rim 24, which stops the evaporation.

Figure 19:
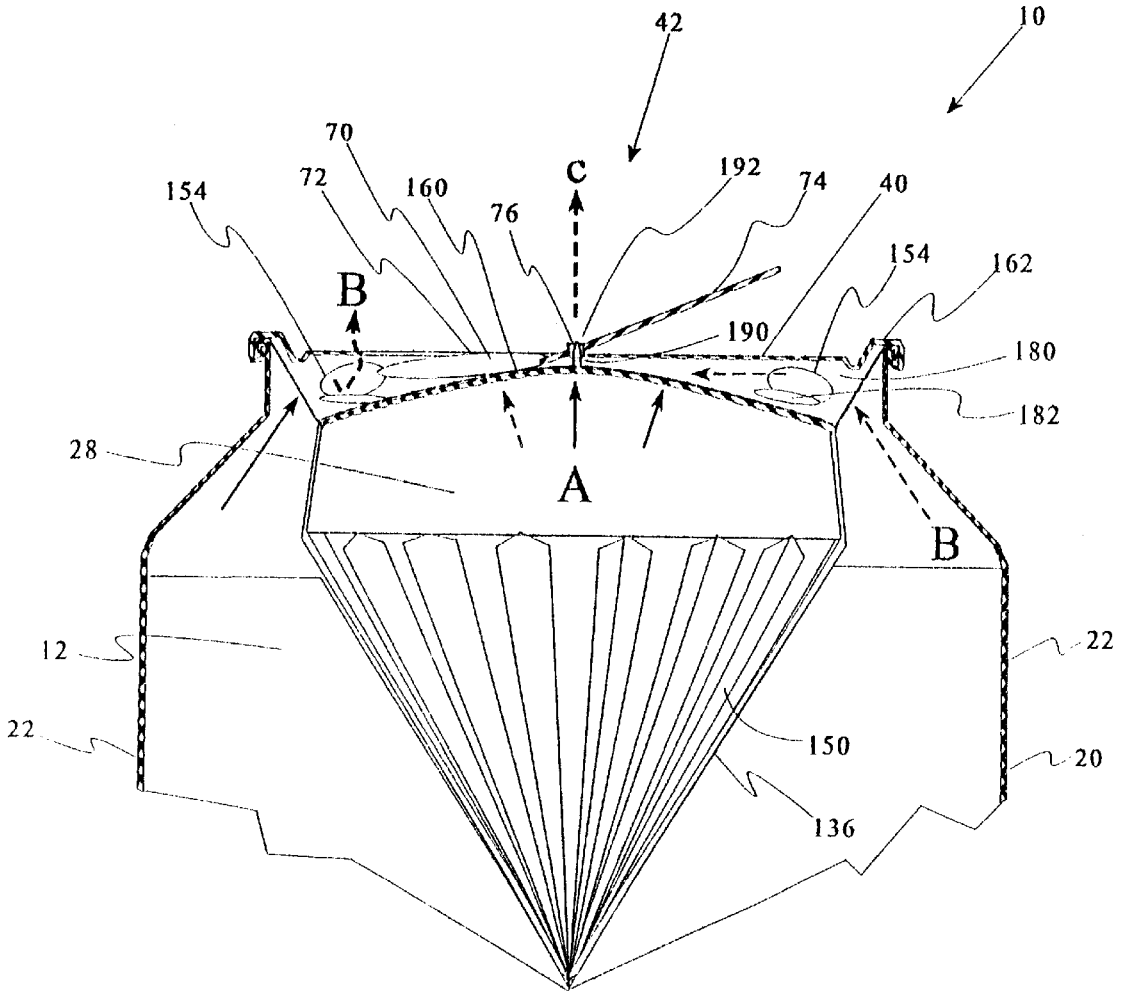
FIG. 19 is a view as in FIG. 18, showing conditions immediately after opening of the lid opener mechanism.

FIG. 19 shows apparatus 10 a moment after lid opener mechanism 42 is opened by pulling the pull-tab 74 and opening a lid port 70. The lid port 70 has been broken exposing the receptacle 150 and chamber 180 to atmospheric pressure. Refrigerant 28 gas contained in chamber 180 under pressure escapes to atmosphere thereby resulting in loss of pressure equilibrium between chamber 180, receptacle 150 and container 20. This causes top wall 160 of receptacle 150 to deform upwardly causing nozzle 190 to pierce container lid 40.

At the same time fragile regions 182 break away from the receptacle top wall 160 exposing the contents of chamber 180 to the port for release. Receptacle 150 expands to a maximum state during evaporation but does not tear, so that no further pressure is transmitted to beverage 12 product during the process of cooling. Beverage 12 thus remains inside container 20 until the container 20 is tilted for consumption.

Refrigerant 28 contained in chamber 180 escapes through nozzle 190 as shown by arrow C. As the refrigerant 28 boils, it cools the receptacle 150 wall and thus effectuates the cooling of beverage 12 in chamber 180. At the end of the evaporation cycle, the cooled beverage 12 may be consumed through the drink port 70 as indicated by arrows B.

Fourth Preferred Embodiment

The fourth embodiment of apparatus 10 is similar to the second embodiment in that a vessel is provided within a container defining there-between an annular refrigerant receptacle chamber. See FIGS. 20–24. In this instance, however, container 220 has a container shoulder portion 222 and a container neck portion 224 opening through a container rim 226. Therefore vessel 230 also has a vessel shoulder portion 232 and a vessel neck portion 234, and the annular refrigerant chamber 240 extends up to the top of the two neck portions 224 and 234. The exterior surface of the container neck portion 224 upper end is threaded to receive an internally threaded container cap 250, including a cap cylindrical side wall 252 and a cap top wall 254 which makes sealing contact with container rim 226. Cap 250 can be unscrewed to both release refrigerant 28 for beverage 12 cooling and to provide consumption access to beverage 12 when container 220 is tilted. Vessel 230 preferably fills about eighty percent of the container 220 interior volume available for retaining beverage 12.

Cap 250 preferably is a plastic member formed by injection molding. Cap 250 includes a resealable sealing plug 256 fitted into a cap port 258 in cap top wall 254. See FIG. 22. Resealable plug 256 is retained in cap port 258 partly by the vessel 230 internal pressure against the plug sealing flange 260. The internal pressure against sealing plug 256 is normally too great for plug dislodgment by the finger of a consumer until the refrigerant 28 has been released and the beverage 12 cooling decreases internal pressure. A very narrow cap passageway 262 is provided through cap top wall 254 directly over the portion of annular chamber 240 between neck portions 224 and 234. A passageway plug assembly 264 with pull tab 266 is fitted into passageway 262. A charge of refrigerant 28 can be introduced into annular chamber 240 through passageway 262 after assembly of cap 250 onto container 220.

An annular cylindrical projection 272 preferably extends downwardly from cap top wall 254 around cap port 258, and seals vessel neck 234 when cap 250 is screwed onto container 220.

Method of Assembly

Vessel 230 is preferably blow molded from plastic, but may also be formed of an aluminum foil with a foil vessel neck portion 234 attached. During manufacture vessel 230 preferably is filled with beverage 12 in the conventional way and then a special cap (not shown) is used to seal the container forming a hermetic seal between container 220 and vessel 230. After the beverage 12 filling process is completed, cap 250 is screwed onto container 220 and a seal is made between container rim 226 and cap top wall 254. Chamber 240 preferably is then charged with liquefied refrigerant 28 by inserting a puncturing charge valve (not shown) through passageway 262.

Figure 24:
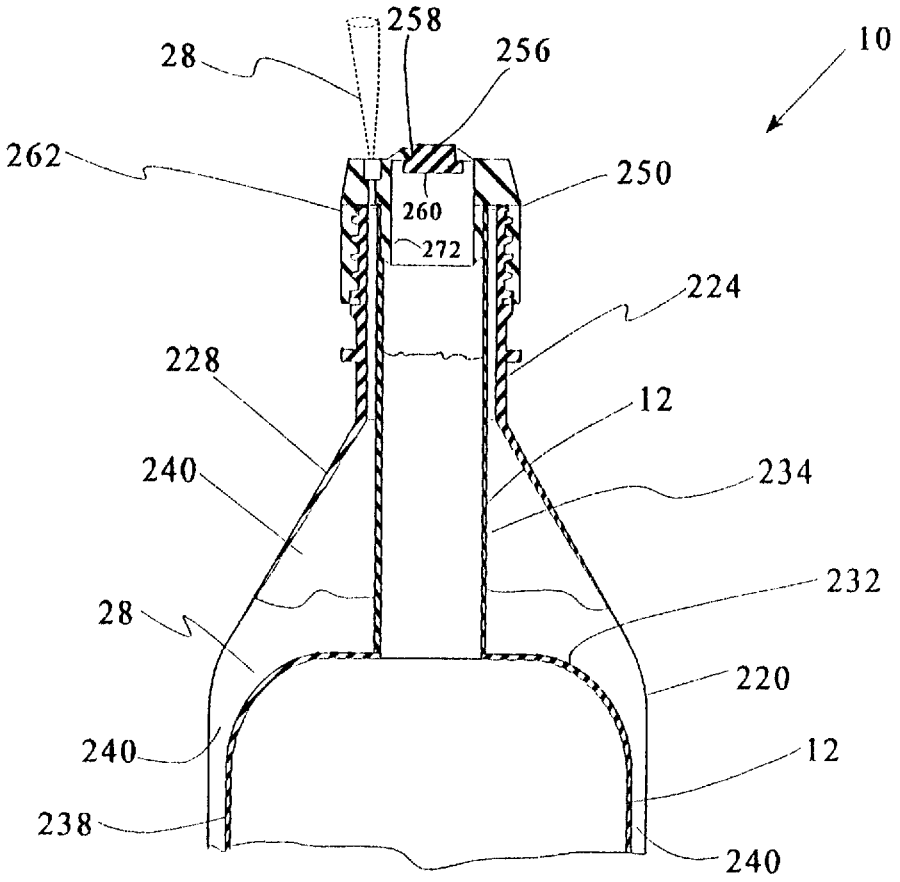
FIG. 24 is a view as in FIG. 23 of just the upper portion of the apparatus with a plum of refrigerant escaping from the refrigerant passageway in the cap.

FIG. 24 shows the container 220 assembled and in use during the cooling process. In FIG. 24 a passageway plug 274 has been removed to release refrigerant 28 into the atmosphere and thus to effectuate cooling of the beverage 12. Passageway 262 preferably is sufficiently narrow to cause gaseous refrigerant 28 to escape at a speed exceeding the combustion speed, as described for nozzles of previous embodiments.

Refrigerant 28 can alternatively be poured directly into the empty container 220 during the apparatus 10 manufacturing process. A charge of refrigerant 28 is mixed with cryogenically cold $LCO_2$ (liquid carbon dioxide) or $LN_2$ (liquid nitrogen) and the mixture is poured into the container 220 just before receptacle 230 is inserted. As the containers 220 travel to the receptacle 230 insertion station, and to the beverage 12 filling station, the cold cryogenic fluid evaporates slowly, supercooling the refrigerant 28. Thus the refrigerant 28 remains in liquified form throughout the manufacturing process with very little evaporation taking place. When the vessel 230 is inserted into the container 220, the level of refrigerant 28 rises, and some evaporation might take place due to the influx of some heat from the relatively warm vessel 230 and container 220 walls 238 and 228. The gas 28 thus created exits container 220 by flowing between the sealing flange of vessel 230 and the container rim 226.

Container 220 is then filled with beverage 12 and the sealing cap 250 is attached to form two sealed chambers within container 220, one holding the refrigerant 28 and the other holding beverage 12. In this case the common conventional cap 250 can be used with the system, and no plug 256 is necessary. Thus, the manufacturing of the containers 220 does not change substantially.

It is important that the amount of $LCO_2$ (liquid carbon dioxide) or $LN_2$ (liquid nitrogen) used be calibrated exactly. The evaporation of the $LCO_2$ or $LN_2$ should be completed by the time the closure cap 250 is attached to container 220. This is because the pressure of $LCO_2$ or $LN_2$ used can be very high and undesirable as its temperature increases with time, and this could result in rupture of container 230 after a period of time after which its vapor pressure increases beyond the pressure limit of the container.

Figure 20:
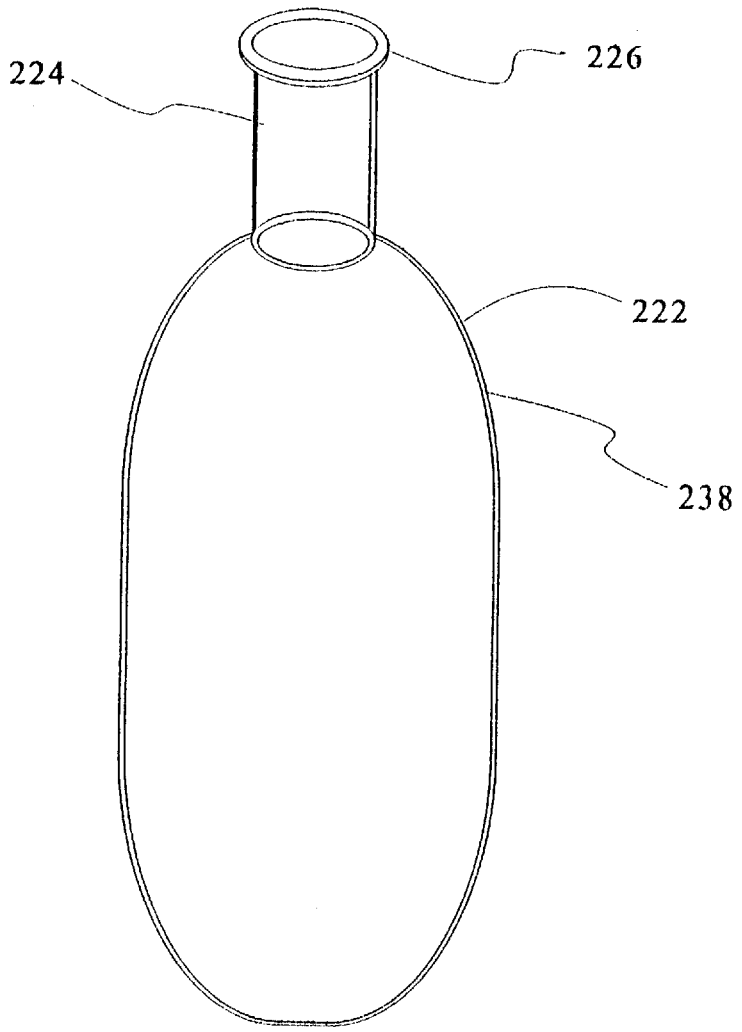
FIG. 20 is a perspective view of a container such as a bottle having a shoulder portion and a narrow neck portion
Figure 21:
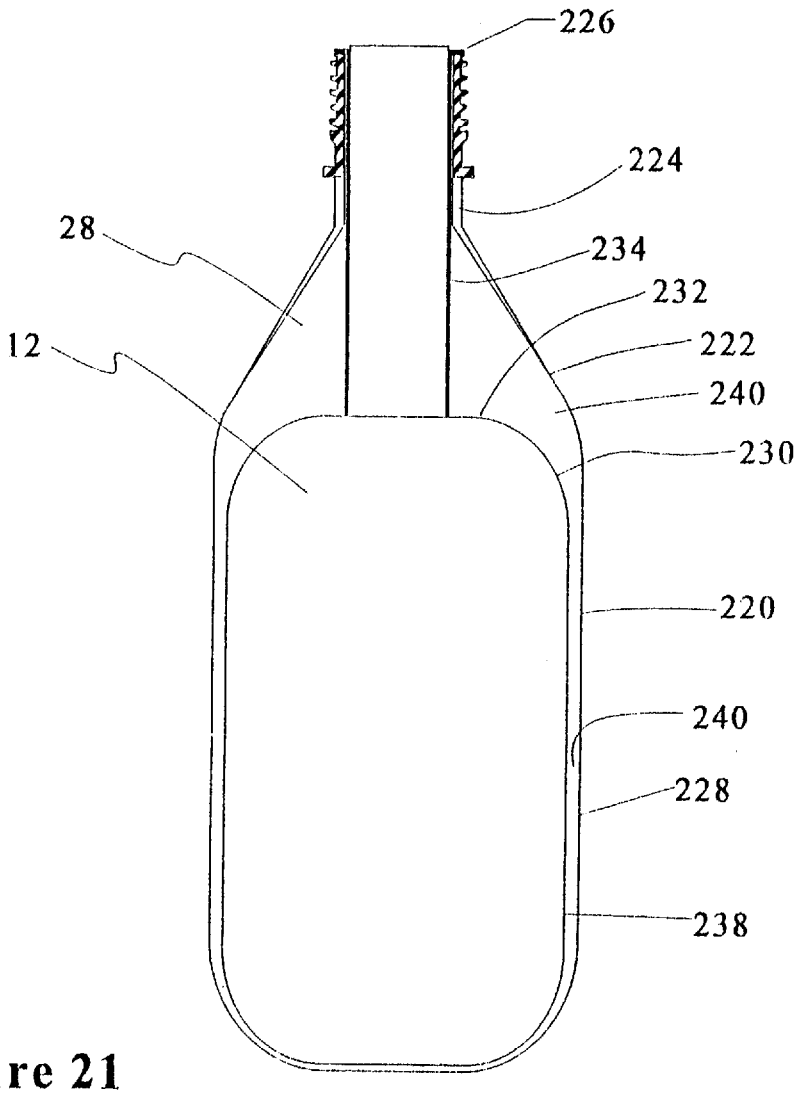
FIG. 21 is a cross-sectional side view of the container of FIG. 20 with a secondary vessel placed inside, the secondary vessel also having a shoulder portion and a neck portion, the container and vessel together defining an annular refrigerant receptacle chamber.
Figure 22:
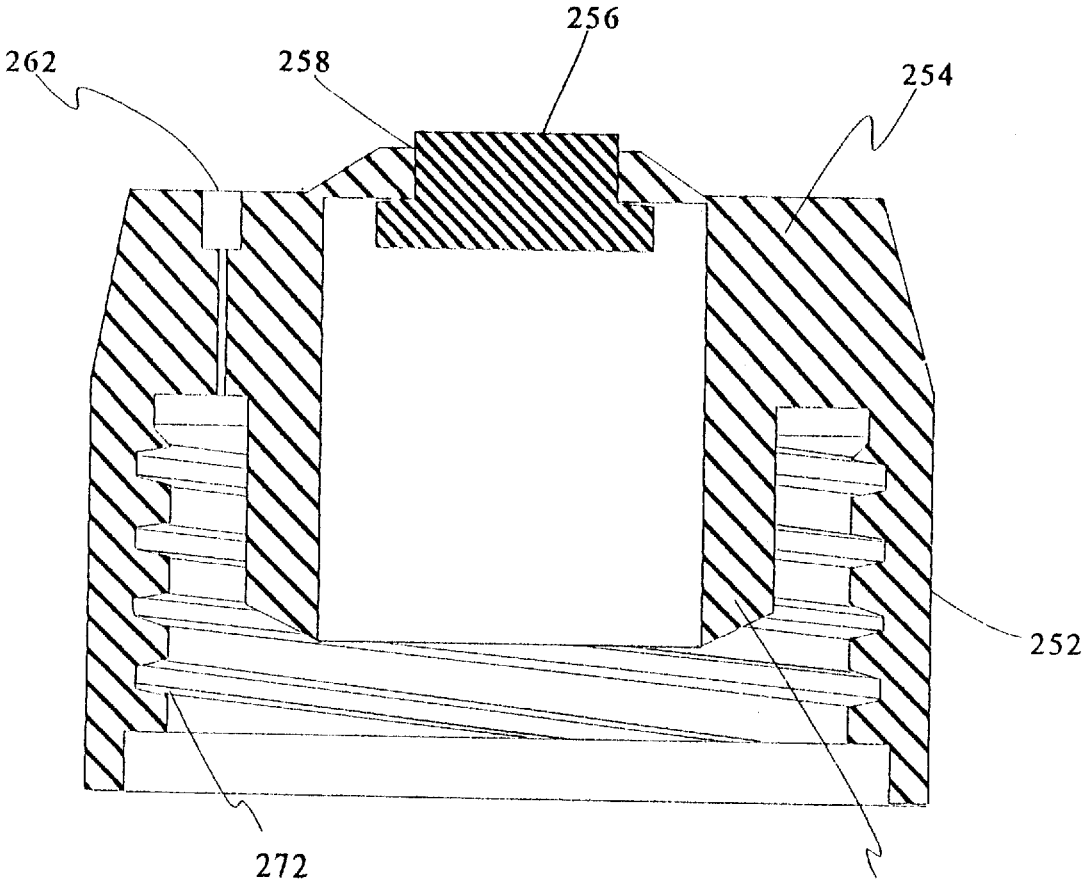
FIG. 22 is a cross-sectional side view of the preferred cap having a refrigerant passageway and a beverage passing port.
Figure 23:
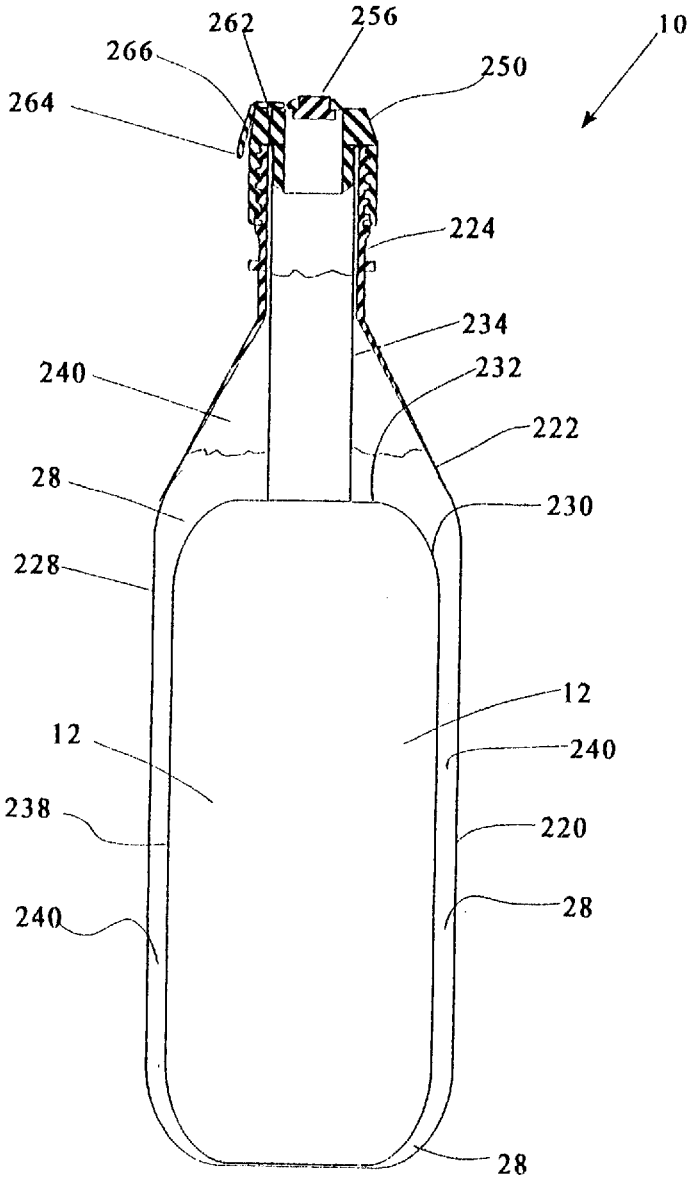
FIG. 23 is a cross-sectional view as in FIG. 21, with the preferred cap, pull tab cap opener, and the beverage and refrigerant added.

It must be appreciated that an ordinary closure means of the variety typically used with such containers may be used together with the vessel 230, instead of the special cap 250 illustrated in FIG. 20. In such a case the charge valve (not shown) would be used to puncture a hole through the closure means. Then after charging the refrigerant 28, the hole thus created for charging could be plugged by means of a removable mating plug or by smearing removable plastic melt over the hole.

In line with other advantages recited in this disclosure, the container 220 may be a beverage container such as a can or bottle. The contents of the container can then comprise any form of beverage 12 whether alcoholic or non-alcoholic, or carbonated or non-carbonated.

Fifth Preferred Embodiment

Figure 25:
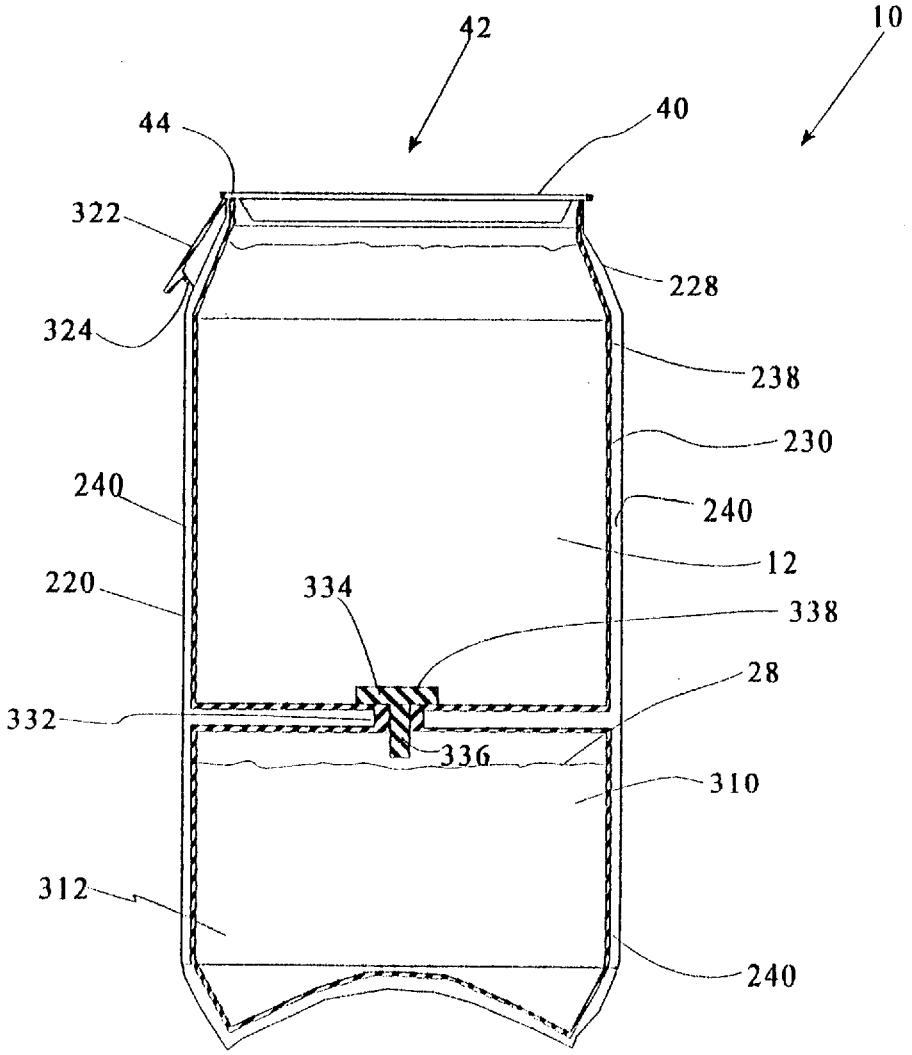
FIG. 25 is a cross-sectional side view of the fifth embodiment of the apparatus.
Figure 26:
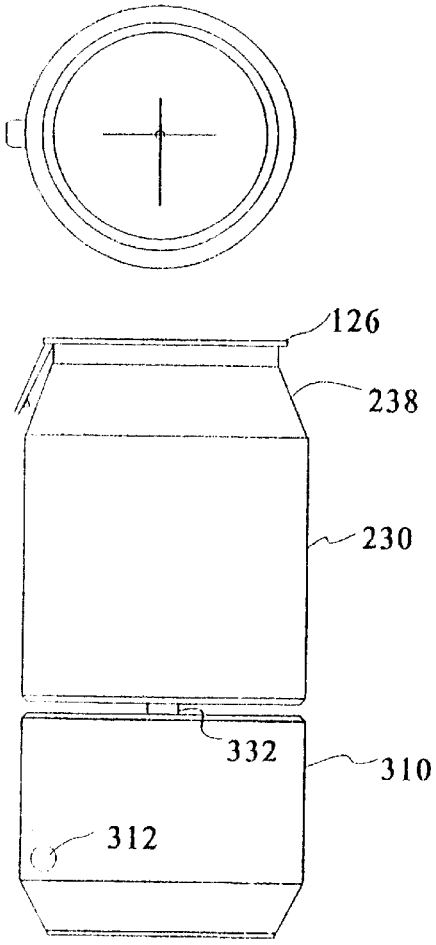
FIGS. 26 and 27 are views of the vessel and receptacle of the fifth embodiment which fit into the container.
Figure 27:
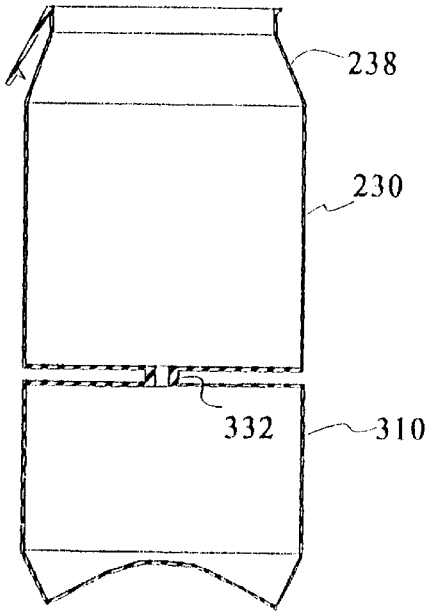

The fifth embodiment of apparatus 10 is similar to the fourth embodiment in that a vessel 230 is provided within a container 220 defining there-between an annular refrigerant receptacle chamber 240. See FIGS. 25–27. In this instance, inner vessel 230 terminates a distance above the bottom of container 220, and a cylindrical refrigerant retaining receptacle 310 is provided in this lower container 220 region. The wall of receptacle 310 has thin, fragile rupture sections 312 around its circumference. A container wall piercing mechanism 320 is provided, preferably including a pivoting tab 322 having a tab end crimped together with lid lateral flange 44 and container rim 226. A piercing prong 324 protrudes from a face of tab 322 toward container wall 228. When beverage 12 consumption is desired, the consumer applies pressure to tab 322 and thereby drives prong 324 into container wall 228, opening a release port in container wall 228. This action causes above-atmospheric pressure within the annular chamber 240 to diminish and therefore causes rupture section 312 to tear open. Refrigerant 28, which is by its nature at a pressure above atmospheric at ambient temperature, bursts through rupture sections 312 and flows through annular chamber 240 to exit the opening made by prong 324. Then the lid 40 of container 220 is opened with a conventional opener mechanism 42 and the cooled beverage 12 is available for consumption.

It is preferred that vessel 230 and receptacle 310 be interconnected by a tubular passageway 332, through which refrigerant 28 is preferably charged. Then passageway 332 is closed with a plug 334, preferably having a stem portion 336 for snug fitting into passageway 332 and a lateral flange 338.

General Commentary

Advantageously, the refrigerant 28 comprises a component having relatively good thermodynamic properties at room temperature. For example, the refrigerant 28 may comprise an HFC such as HFC-152a, Dymel-A, or a mixture of butane, HFCs and ethers or E134.

It should be appreciated, however, that any combination of appropriate gases may be employed and HFC-152a and HFC-134a merely serve as examples. In particular, advantageously cost effective inflammable gases may be employed as the refrigerant since the receptacle can be readily arranged such that the velocity of gas exiting from the receptacle can arranged to be high enough to exceed the flame speed limit of the gas. This can advantageously prevent any combustion of the whole refrigerant 28 in the receptacle occurring in any situation in which the escaping refrigerant might accidently be ignited as described earlier.

Preferably the opening of the receptacle allows for the at least partial expansion or partial collapse of the receptacle and for the escape of evaporating refrigerant previously introduced into the receptacle.

Preferably the receptacle is sealingly connected to the closure member used, whether it is a crimpable lid on a metal or plastic container, or a crimpable or threadable closure member or lid on a plastic or glass bottle container.

Advantageously the receptacle and container are sealably connected by means of the crimped lid or by means of a threadable closure member.

Preferably the expansion or contraction occurs to a size and shape which does not represent the maximum possible expansion volume of the minimum possible contracted volume of receptacle.

It will therefore be appreciated that the present invention provides for a particularly cost effective and efficient manner in which the contents of a container can be readily cooled by the intended end user of the container, i.e., consumer of the contents, as and when required.

Particular advantages will of course be apparent from the preceding description. For example if a carbonated beverage is involved, the carbonation of the beverage is actually conserved by the receptacle since the contents of the receptacle will now perform the function previously performed by the dead carbonation gas in a standard beverage container. Also, the refrigerant within the receptacle will allow for the expansion and contraction of the beverage during changes in ambient temperature. Since the carbonation is suppressed until the receptacle is activated, i.e., open to atmosphere, the carbonation in the beverage is conserved until the beverage is required to be consumed.

According to a particular feature of the invention, the receptacle is crimped to the container and the lid during manufacture forming two or more separate chambers. Alternatively the receptacle is sealably connected to the container by a threaded closure forming two or more chambers.

According to a particular feature of the invention, the entire potential surface area of the receptacle is available for the heat exchange process and, as the receptacle decreases in volume, so as to reduce the volume of the refrigerant therein, the refrigerant comes into contact with an ever increasing area of the inner wall of the receptacle, and thus, indirectly, an ever increasing area of thermal contact with the containers contents.

Advantageously, the apparatus of the present invention can be One hundred percent recyclable. The plastic advantageously used for forming the receptacle can be the same as that used in forming plastic beverage bottles and the aluminum foil receptacle is also one hundred percent recyclable.

The pressure built up within the receptacle can be appropriately selected but, in one particular example, is no more than 60 pounds per square inch (psi) at full charge and at a temperature of 70 degrees Fahrenheit. Although the apparatus of the present invention will achieve the refrigeration of the contents of the container at a slower rate when located in a cold environment, effective refrigeration is still achieved, in hot environments, the apparatus of the present invention will generally be under higher pressure and so will assist in cooling the contents of the container more than would be expected in a cooler environment.

The receptacle of the present invention is particularly advantageous since one size is suitable for use with a large variety of different size containers and this enhances the economic viability of the present invention. Also the refrigerant suitable for use with the present invention can comprise non-ozone-depleting refrigerants so that the present invention can be considered to be quite environmentally friendly.

As regards potential malfunction of the apparatus to the present invention, if the receptacle is defective during the canning/bottling process, it will not hold the required pressure of the refrigerant and, in instances where the receptacle is to form a seal, such a defect will be readily identifiable.

Also, as regards the bottling/canning process, the receptacle may be charged before, during or after the containers passage along the processing lines such that the present invention can be readily incorporated into currently established automated production lines.

The invention is not restricted to the details of the foregoing embodiments. For example, the invention can be used with any appropriate container serving to contain any appropriate material that advantageously needs to be cooled at a particular time. While finding particular use in the drinks industry, it should be appreciated that the concept of the present invention can be readily incorporated into a container for use with any form of food product or other product as required.

Also, although some of the aforementioned features have been discussed in relation to a can, and some in relation to a bottle, it should be understood that the particular aspects of the present invention depend very little upon the nature of the container and so the various features illustrated with cans could be readily incorporated into other containers such as bottles and vice-versa.

Further, in order to prevent spillage or liquified refrigerant when the container is tilted from the normal upright position, the invention can employ two or more flexible-walled receptacles forming multiple skin layers around a refrigerant chamber. Thus, by employing this "onion skin" of multiple layers, the refrigerant in its liquid phase must pass through a labyrinth of narrow passages before exiting from the receptacle, by which time, full evaporation of the refrigerant can generally be ensured. Also, several flexible-walled receptacles can be connected in series, or in parallel, to form a heat exchange receptacle having a large surface area and multiple compartments for the storage of portions of the refrigerant charge. This has the advantage that the refrigerant can be stored over a large surface area, it is therefore possible to form as required a plurality of chambers to provide for the heat exchange surfaces and refrigerant store chambers simultaneously. Further, it is also possible to form a variety of surface patterns for maximum exposure of the refrigerant to different levels of the contents of a container.

The present invention has a variety of major advantages. For example, the flexible-walled receptacle is not subjected to any stress since it is supported on all sides by its own transfer pressure acting on the contents of the container. The maximum stress on the receptacle walls is no more than due to any particular change in shape that occurs. This means that, at full pressure, the collapsible walls of the receptacle will not be stretched or subjected to any hoop or lateral pressure stresses.

The contents of the container are also prevented from escaping while the receptacle is pressurized with refrigerants since a portion of the receptacle wall can form a seal around an outlet opening of the container. Also, the maximum available free volume within the container can be used to store refrigerant since the receptacle will readily expand to fill the maximum available volume within the container.

Any carbonation within the beverage does not escape, nor is the beverage readily exposed to the taste of the beverage. Since the operation of the present invention does not depend upon carbonation pressure within a beverage, the carbonation pressure can readily be retained until the cooling process is over and the beverage is ready for consumption.

Furthermore, the maintenance of the pressure within the beverage also helps in maintaining other pressure/release devices associated with beverage, i.e., those for providing a creamy head to canned beer, intact. The surface area of the receptacle available for heat exchange process can advantageously be maximized at little or no additional cost during manufacture by simple rearranging of the topology of the receptacle. The volume of the container's contents displaced by the flexible wall of the receptacle is negligible in view of the thin-walls employed.

As mentioned above, any internal hoop and lateral wall pressure stresses within the receptacle according to the present invention are negligible since the receptacle expands to a state of equilibrium between the pressure inside and outside the receptacle and, further, there is little or no change of an internal explosion occurring.

The receptacle may advantageously be charged at any time during or after the beverage filling process and so the invention can be readily incorporated into any high speed production line such as a high speed canning or bottling production line.

Also, as a further alternative, the receptacle can be arranged to occupy a volume less than, for example, the head space in the container so that, if required, the remaining space in the container can be occupied by for example, pressurized gas.

Finally, from the above description, it will be of course appreciated that a particularly important aspect of the present invention is the ability of the surface area, the volume and the shape of the receptacle arranged to receive the refrigerant to change in response to any variations in the pressure internal or external to the receptacle.

It will be appreciated that other modifications and variations may be made to the embodiments described and illustrated within the scope of the present invention.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A rapid refrigeration apparatus comprising:

a primary container means having a primary container upper end, a primary container wall having an inwardly beveled primary upper wall portion surrounding a primary container opening, said primary container opening being bordered by a primary container rim;

a secondary container means smaller than and positioned within said primary container means, said secondary container means having a secondary container upper end, a secondary container wall having an inwardly beveled secondary upper wall portion surrounding a secondary container opening and having a cup wall opening means, said secondary container opening being bordered by a secondary container rim, such that said secondary container rim rests against and is sealingly secured to said primary container rim and such that an annular refrigerant receptacle chamber is defined between said primary and secondary container walls;

liquified refrigerant contained within said annular refrigerant receptacle chamber;

liquid container contents in said secondary container means;

a buoyant sealing cup having a beveled cup side wall tapering toward said secondary container opening and sized to fit sealingly into said inwardly beveled secondary upper wall portion, said cup beveled side wall having at least one cup side wall port;

and lid means sealingly secured to said secondary container rim and comprising lid opening means for releasing said refrigerant from said receptacle chamber into the atmosphere and for releasing said container contents from said receptacle for consumption; said lid opening means comprising a lid opening means activation means for voluntarily opening said lid opening means at a selected moment in time;

such that activating said lid opening means lowers the pressure of gas within said sealing cup to atmospheric causing the pressure between the sealing cup and the remainder of said secondary container means to press said sealing beveled cup side wall into sealing contact with said inwardly beveled secondary upper wall portion, and causing said cup wall opening means to open and release gaseous refrigerant through said cup port and into said cup and through said lid opening means into the atmosphere, cooling said container contents; and substantially relieving lateral sealing pressure on said cup wall opening means such that said cup floats and angles away from said lid upon tilting of said apparatus permitting said container contents to flow over and around said cup and out of said apparatus through said lid opening means.

2. A rapid refrigeration apparatus comprising:

a primary container means having a primary container upper end, a primary container wall having a primary container shoulder portion and a primary container neck portion surrounding a primary container opening, said primary container opening being bordered by a primary container rim;

a collapsible secondary container means smaller than and positioned within said primary container means, said secondary container means having a secondary container upper end, a secondary container wall having a secondary container shoulder portion and a secondary container neck portion surrounding a secondary container opening, said secondary container opening being bordered by a secondary container rim, such that an annular refrigerant receptacle chamber is defined between said primary and secondary container walls;

refrigerant contained within said annular refrigerant receptacle chamber;

liquid container contents within said secondary container means;

cap means removably and sealingly fitted onto said primary and secondary container rims.

3. An apparatus according to claim 2, wherein said container neck portion is externally threaded and wherein said cap means comprises a top wall and a cylindrical side wall is internally threaded, such that said cap side wall engagingly screws onto said container neck portion.

4. An apparatus according to claim 3, said cap means additionally comprising a cap port and a cap port plug removably and sealing fitted into said cap port for releasing said container contents.

5. A rapid refrigeration apparatus comprising:

a primary container means having a primary container wall with a primary container opening bordered by a primary container rim;

a collapsible secondary container means having an interior space defining a first chamber and having a secondary container wall with a secondary container opening bordered by a secondary container rim, said secondary container means extending within said primary container means, and said secondary container means being sized to fit into said primary container means and to thereby define a second chamber between said primary container means and said secondary container means;

sealing means sealingly interconnecting said primary container rim and said secondary container rim;

lid means secured to at least one of said primary container rim and said secondary container rim;

refrigerant contained within one of said first chamber and said second chamber;

and means for releasing said refrigerant into the atmosphere.

6. An apparatus according to claim 5, wherein the space between said primary container means and said secondary container means defining said second chamber is substantially annular.

7. An apparatus according to claim 6, wherein said second chamber contains said refrigerant.

8. An apparatus according to claim 6, wherein said first chamber contains said refrigerant.

9. An apparatus according to claim 6, wherein said means for sealingly interconnecting said primary container rim and said secondary container rim comprises said lid means.

10. An apparatus according to claim 1, wherein said secondary container rim is sealingly secured to said primary container rim by crimping.

11. An apparatus according to claim 2, wherein said secondary container rim is sealingly secured to said primary container rim and said cap means is sealingly secured to said primary and secondary container rims by crimping.

12. A rapid refrigeration apparatus comprising:

a primary container means having a primary container upper end, a primary container wall having a primary container shoulder portion and a primary container opening, said primary container opening being bordered by a primary container rim;

a secondary container means smaller than and positioned within said primary container means, said secondary container means having a secondary container upper end, a secondary container wall having a secondary container opening, said secondary container opening being bordered by a secondary container rim, such that an annular refrigerant receptacle chamber is defined between said primary secondary container walls;

refrigerant contained within said annular refrigerant receptacle chamber;

liquid container contents within said secondary container means;

refrigerant release means for selectively releasing said refrigerant into the atmosphere;

and cap means removably and sealingly fitted onto said primary and secondary container rims, said cap means including a lid panel having a beverage release port with a certain diameter and a trap door having a trap door diameter of at least said certain diameter and being pivotally secured to said lid panel beneath and in sealing relation with said beverage release port, said certain diameter and said trap door diameter being sized to be pivotable with a user thumb into said primary container only after reduction of pressure within said primary container by the release of said refrigerant through said refrigerant release means.

13. A rapid refrigeration apparatus comprising:

a primary container means having a primary container wall with a primary container opening bordered by a primary container rim;

a collapsible secondary container means having an interior space defining a first chamber and having a secondary container wall with a secondary container opening bordered by a secondary container rim, said secondary container means extending within said primary container means, and said secondary container means being sized to fit into said primary container means and to thereby define a second chamber between said primary container means and said secondary container means;

sealing means sealingly interconnecting said primary container rim and said secondary container rim;

lid means secured to at least one of said primary container rim and said secondary container rim;

refrigerant contained within one of said first chamber and said second chamber;

and means for releasing said refrigerant into the atmosphere.

* * * * *